US009341973B2

(12) United States Patent
Yoshifuku et al.

(10) Patent No.: US 9,341,973 B2
(45) Date of Patent: May 17, 2016

(54) MAGNETIC CARRIER, TWO-COMPONENT DEVELOPER, DEVELOPER FOR REPLENISHMENT, AND IMAGE FORMING METHOD

(71) Applicant: CANON KABUSHIKI KAISHA, Tokyo (JP)

(72) Inventors: Minoru Yoshifuku, Iga (JP); Wakashi Iida, Toride (JP); Hironori Minagawa, Moriya (JP); Nobuyoshi Sugahara, Tokyo (JP); Yuto Onozaki, Shimotsuma (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 14/290,703

(22) Filed: May 29, 2014

(65) Prior Publication Data

US 2014/0356783 A1 Dec. 4, 2014

(30) Foreign Application Priority Data

May 30, 2013 (JP) ..... 2013-113777

(51) Int. Cl.

| | |
|---|---|
| ***G03G 9/10*** | (2006.01) |
| ***G03G 9/113*** | (2006.01) |
| ***G03G 9/107*** | (2006.01) |

(52) U.S. Cl.

CPC ..... *G03G 9/1132* (2013.01); *G03G 9/10* (2013.01); *G03G 9/107* (2013.01); *G03G 9/1075* (2013.01); *G03G 9/113* (2013.01); *G03G 9/1133* (2013.01); *G03G 9/1136* (2013.01)

(58) Field of Classification Search

CPC ..... G03G 9/10; G03G 9/107; G03G 9/113; G03G 9/1132; G03G 9/1133; G03G 9/1136; G03G 9/1075

See application file for complete search history.

(56) References Cited

U.S. PATENT DOCUMENTS

2009/0263739 A1* 10/2009 Sugiura ..... G03G 9/107 430/111.32
2011/0195357 A1 8/2011 Sugiura

FOREIGN PATENT DOCUMENTS

| | | | |
|---|---|---|---|
| JP | 4-93954 | A | 3/1992 |
| JP | 2009-175666 | A | 8/2009 |
| JP | 2012-063571 | A | 3/2012 |
| WO | 2012/074035 | A1 | 6/2012 |
| WO | 2013/002296 | A1 | 1/2013 |

* cited by examiner

*Primary Examiner* — Peter Vajda

(74) *Attorney, Agent, or Firm* — Canon U.S.A., Inc. IP Division

(57) ABSTRACT

There is provided a magnetic carrier having a resin coating layer formed on the surface of each of particles prepared by putting resin in the pores of porous magnetic particles, wherein (i) the surface roughness Ra of the porous magnetic particles ranges from 0.180 μm to 0.250 μm, (ii) the pore size ranges from 0.40 μm to 1.00 μm, (iii) the amount of the resin held in the pores ranges from 3.0 parts by mass to 5.5 parts by mass relative to 100 parts by mass of the porous magnetic particles, (iv) the amount of resin used for forming the coating resin layer ranges from 1.0 parts by mass to 3.0 parts by mass relative to 100 parts by mass of the porous magnetic particles, and (v) the surface roughness Ra of the magnetic carrier ranges from 0.160 μm to 0.220 μm.

9 Claims, 2 Drawing Sheets

MAGNETIC CARRIER, TWO-COMPONENT DEVELOPER, DEVELOPER FOR REPLENISHMENT, AND IMAGE FORMING METHOD

BACKGROUND OF THE INVENTION

1. Field of the Invention

The present invention relates to a magnetic carrier, a two-component developer, and a developer for replenishment which are each used for visualizing an electrostatic image by electrophotography; the present invention also relates to an image forming method in which the magnetic carrier, the two-component developer, and the developer for replenishment are used.

2. Description of the Related Art

In general electrophotographic image forming methods which have been typically employed, an electrostatic latent image is formed on an electrostatic latent image-bearing member by various techniques, and toner is attached to the electrostatic latent image to develop the electrostatic latent image. In the development of the electrostatic latent image, two-component development has been widely employed; in particular, a particulate carrier called magnetic carrier is mixed with toner for triboelectric charging of the toner with the result that the toner receives a proper amount of positive or negative charge, and the electrostatic latent image is developed with the charge that serves as driving force.

In the two-component development, the magnetic carrier can be mixed with the toner to charge and carry the toner; hence, the magnetic carrier plays a distinct role from the toner, which produces advantages such as enabling the properties of the developer to be well controlled.

In recent years, technical progress in electrophotography has generated increasingly high demands for formation of a high-definition image and stable formation of a high-quality image as well as high-speed processing and the prolonged lifetime of an apparatus. In order to satisfy such demands, improving the performance of a magnetic carrier and decreasing the specific gravity thereof have been needed.

In one of techniques which have been proposed, uneven image density in long-term use and a color change in full-color printing are reduced (Japanese Patent Laid-Open No. 4-93954). In this technique, the core of a magnetic carrier has an uneven surface profile, and the core is coated with resin such that irregularity reflecting the uneven surface profile remains on the surface of the coated core. Although such an approach satisfies the above-mentioned requirements to some extent, the magnetic carrier particles have a large specific gravity and thus apply a load onto the toner; hence, the lifetime of the developer becomes short in a recent circumstance in which high-speed printing is needed. Thus, further improvement has been needed to satisfy demands for high image quality and adaptability to a change in environment.

Under such a circumstance, other techniques have been proposed, which involve use of a magnetic carrier which includes a porous magnetic core having pores formed therein and a small specific gravity (Japanese Patent Laid-Open Nos. 2009-175666 and 2012-63571). Such techniques have prolonged the lifetime of a toner to some extent.

These days, office network has been becoming common, and service for users of copiers, such as e-maintenance, has been popular; then, such a tendency has led to a maintenance-free system. In view of introduction of a maintenance-free system, a magnetic carrier having a longer lifetime is needed, and it is therefore highly necessary to develop a magnetic carrier and two-component developer satisfying such a need as well as an image forming method in which the magnetic carrier and the two-component developer are used.

SUMMARY OF THE INVENTION

The inventors have found the following: use of a magnetic carrier including a porous magnetic particle and having a surface roughness specified below eliminates carrier adhesion and damage of an electrophotographic apparatus due to broken carrier particles, and such a magnetic carrier has a stable charging ability even in long-term use and thus excludes a reduction in developability.

An aspect of the present invention provides a magnetic carrier which includes resin-filled magnetic core particles including porous magnetic particles and resin held in the pores of the porous magnetic particles and a resin coating layer formed on the surface of each of the resin-filled magnetic core particles, wherein (i) the surface roughness Ra of the porous magnetic particles is in the range of 0.180 μm to 0.250 μm, (ii) within the pore size ranging from 0.1 μm to 3.0 μm in the pore size distribution of the porous magnetic particles, the peak pore size in which the differential pore volume is maximum is in the range of 0.40 μm to 1.00 μm, (iii) the amount of the resin held in the pores is in the range of 3.0 parts by mass to 5.5 parts by mass relative to 100 parts by mass of the porous magnetic particles, (iv) the amount of resin used for forming the resin coating layer is in the range of 1.0 part by mass to 3.0 parts by mass relative to 100 parts by mass of the porous magnetic particles, and (v) the surface roughness Ra of the magnetic carrier is in the range of 0.160 μm to 0.220 μm.

Another aspect of the present invention provides a two-component developer which includes toner containing a binder resin, a colorant, and a release agent and a magnetic carrier, wherein the magnetic carrier is the above-mentioned magnetic carrier.

Another aspect of the present invention provides an image forming method which includes a charging step for charging an electrostatic latent image-bearing member, an electrostatic latent image-forming step for forming an electrostatic latent image on the surface of the electrostatic latent image-bearing member, a developing step for developing the electrostatic latent image with a two-component developer held in a developing device to form a toner image, a transferring step for transferring the toner image to a transfer medium optionally with an intermediate transfer medium, and a fixing step for fixing the transferred toner image to the transfer medium, wherein the two-component developer is the above-mentioned two-component developer.

Another aspect of the present invention provides a developer for replenishment which is used in an image forming method including: a charging step for charging an electrostatic latent image-bearing member, an electrostatic latent image-forming step for forming an electrostatic latent image on the surface of the electrostatic latent image-bearing member, a developing step for developing the electrostatic latent image with a two-component developer held in a developing device to form a toner image, a transferring step for transferring the toner image to a transfer medium optionally with an intermediate transfer medium, and a fixing step for fixing the transferred toner image to the transfer medium, wherein the developer for replenishment is supplied to the developing device when the toner concentration in the two-component developer held in the developing device is decreased, an excessive magnetic carrier in the developing device is optionally ejected from the developing device, wherein the developer for replenishment contains a magnetic carrier for replenishment and toner containing a binder resin, a colorant, and a release agent, the amount of the toner is in the range of 2 parts by mass to 50 parts by mass relative to 1 part by mass of the magnetic carrier for replenishment, and the magnetic carrier for replenishment is the above-mentioned magnetic carrier.

Another aspect of the present invention provides an image forming method which includes a charging step for charging an electrostatic latent image-bearing member, an electrostatic latent image-forming step for forming an electrostatic latent image on the surface of the electrostatic latent image-bearing member, a developing step for developing the electrostatic latent image with a two-component developer held in a developing device to form a toner image, a transferring step for transferring the toner image to a transfer medium optionally with an intermediate transfer medium, and a fixing step for fixing the transferred toner image to the transfer medium, wherein a developer for replenishment is supplied to the developing device when the toner concentration in the two-component developer held in the developing device is decreased, an excessive magnetic carrier in the developing device is optionally ejected from the developing device, wherein the developer for replenishment contains a magnetic carrier for replenishment and toner containing a binder resin, a colorant, and a release agent, the amount of the toner is in the range of 2 parts by mass to 50 parts by mass relative to 1 part by mass of the magnetic carrier for replenishment, and the magnetic carrier for replenishment is the above-mentioned magnetic carrier.

Further features of the present invention will become apparent from the following description of exemplary embodiments with reference to the attached drawings.

DESCRIPTION OF THE EMBODIMENTS

Figure 1:
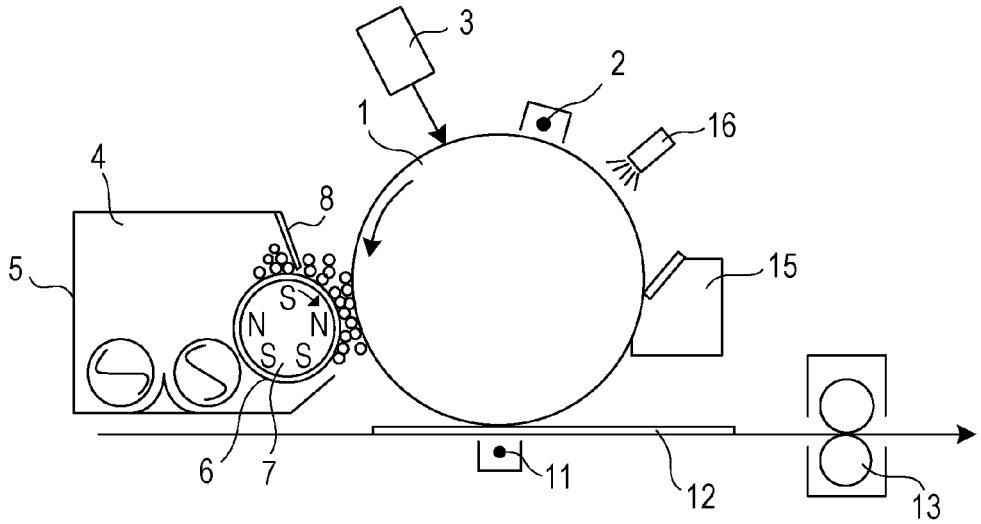
FIG. 1 schematically illustrates an image forming apparatus used in an embodiment of the present invention.

The present invention will now be described in detail.

The magnetic carrier of the present invention includes resin-filled magnetic core particles including porous magnetic particles and resin held in the pores of the porous magnetic particles and a resin coating layer formed on the surface of each of the resin-filled magnetic core particles, wherein (i) the surface roughness Ra of the porous magnetic particles is in the range of 0.180 μm to 0.250 μm, (ii) within the pore size ranging from 0.1 μm to 3.0 μm in the pore size distribution of the porous magnetic particles, the peak pore size in which the differential pore volume is maximum is in the range of 0.40 μm to 1.00 μm, (iii) the amount of the resin held in the pores is in the range of 3.0 parts by mass to 5.5 parts by mass relative to 100 parts by mass of the porous magnetic particles, (iv) the amount of resin used for forming the resin coating layer is in the range of 1.0 part by mass to 3.0 parts by mass relative to 100 parts by mass of the porous magnetic particles, and (v) the surface roughness Ra of the magnetic carrier is in the range of 0.160 μm to 0.220 μm.

In the present invention, arithmetic average roughness Ra (hereinafter referred to as "surface roughness Ra") is employed as the surface roughness for the following reasons: even when some extraordinarily uneven surface profile is present, the measurement is less likely to be affected by the surface profile; and average surface roughness of the magnetic carrier or porous magnetic particles can be more accurately obtained. At surface roughness Ra that is in the range of 0.180 μm to 0.250 μm, uneven surface profile can be retained even after the resin is put in the pores or after the magnetic carrier is coated with resin. The surface roughness that satisfies the above-mentioned range enables the surface roughness of the magnetic carrier to be maintained for a long time and prevents the carrier from being contaminated by toner particles and external additives; thus, stable charging ability can be maintained for a long time, and a high-quality image can be formed.

In the case where the surface roughness Ra of the porous magnetic particles is less than 0.180 μm, a load applied onto a toner particle present between the magnetic carrier particles in a developer becomes large, and a component of the toner is therefore likely to adhere to the surface of the magnetic carrier. As a result, the charging polarity of the magnetic carrier becomes close to that of the toner, which causes carrier adhesion.

In the case where the surface roughness Ra of the porous magnetic particles is greater than 0.250 μm, the particle strength lowers, and the magnetic carrier adhering to an electrostatic latent image-bearing member is therefore broken by the pressure applied by an intermediate transfer member or cleaning blade. Then, fragments of the broken magnetic carrier damage the intermediate transfer member or the electrostatic latent image-bearing member, and the damaged part may cause formation of an image having a white spot. In addition, fragments of the broken magnetic carrier may spread and result in the occurrence of carrier adhesion.

Within the pore size ranging from 0.1 μm to 3.0 μm in the pore size distribution of the porous magnetic particles used in the present invention, the peak pore size in which the differential pore volume is maximum is in the range of 0.40 μm to 1.00 μm. In the case where the peak pore size is less than 0.40 μm, the particle strength is unnecessarily high, and pressure generated in an intermediate transfer process is therefore locally increased; hence, an intermediate transfer member may be damaged, and a defective image may be formed after an endurance test. In the case where the peak pore size is greater than 1.00 μm, the particle strength lowers, fragments of the broken magnetic carrier damage the intermediate transfer member or the electrostatic latent image-bearing member, and the damaged part may cause formation of an image having a white spot. In addition, fragments of the broken magnetic carrier may spread and result in the occurrence of carrier adhesion.

The magnetic carrier of the present invention includes the resin-filled magnetic core particles in which resin has been put in the pores of the porous magnetic particles. The amount of the resin to be put in the pores is in the range of 3.0 parts by mass to 5.5 parts by mass relative to 100 parts by mass of the porous magnetic particles. In the case where the amount of the resin is less than 3.0 parts by mass, the resin permeates the porous magnetic particles, which results in a reduction in the degree of coating with the coating resin. As a result, the charging ability becomes uneven, and the developability of a half-tone image and the stability of image density are reduced; thus, problems such as fogging and toner scattering tend to occur. In the case where the amount of the resin is greater than 5.5 parts by mass, the degree of unevenness formed in the vicinity of the surfaces of the resin-filled magnetic core particles and reflecting the shape of the pores is reduced, and the degree of the unevenness is further reduced by coating with the coating resin. The carrier is therefore contaminated by toner particles and external additives, and thus the charging ability is reduced. In addition, the thickness of the resin layer is increased, and a problem of a blank dot may be caused.

The magnetic carrier has the resin coating layer formed on the surface of each of the resin-filled magnetic core particles. The amount of the resin used for forming the resin coating layer is in the range of 1.0 part by mass to 3.0 parts by mass relative to 100 parts by mass of the porous magnetic particles. In the case where the amount of the resin used for forming the resin coating layer is less than 1.0 part by mass, the degree of the coating is reduced; thus, the charging ability becomes uneven, and the developability of a half-tone image and the stability of image density are reduced, which is likely to cause problems such as fogging and toner scattering. In the case where the amount of the resin used for forming the resin coating layer is greater than 3.0 parts by mass, the thickness of the resin coating layer is increased, and a problem of a blank dot may be caused.

The surface roughness Ra of the magnetic carrier is in the range of 0.160 μm to 0.220 μm. The surface roughness Ra that satisfies the above-mentioned range prevents the carrier from being contaminated by toner particles and external additives; thus, charging ability can be maintained for a long time, and a high-quality image can be formed. In the case where the surface roughness Ra is less than 0.160 μm, the carrier is contaminated by toner particles and external additives, and charging ability is reduced. The developability of a half-tone image and the stability of image density are therefore reduced, which is likely to cause problems such as fogging and toner scattering. In the case where the surface roughness Ra is greater than 0.220 μm, the particle strength lowers, fragments of the broken magnetic carrier damage the intermediate transfer member or the electrostatic latent image-bearing member, and the damaged part may cause formation of an image having a white spot. In addition, fragments of the broken magnetic carrier may spread and result in the occurrence of carrier adhesion.

In the porous magnetic particles used in the present invention, the pore volume which can be obtained by integration of the differential volume of the pores having a size ranging from 0.1 μm to 3.0 μm can be in the range of 20 $mm^3/g$ to 100 $mm^3/g$. The pore volume that satisfies such a range gives a particularly desirable balance between resistance to breakage of the carrier and resistance to damage of the members of an electrophotographic apparatus.

In the magnetic carrier of the present invention, the resin-filled magnetic core particles in which resin has been put in the pores of the porous magnetic particles are coated with resin. Such a structure enables charge relaxation of the magnetic carrier to be controlled, prolongs the lifetime of the developer, and prevents a resistance change due to exposure of the core brought about by damage of the resin coating layer through long-term use, which reduces generation of a defective image.

In the present invention, the coating resin used for coating the resin-filled magnetic core particles can be an acrylic resin, and the acrylic resin can be a copolymer of an acrylic monomer having a molecular structure containing a cyclic hydrocarbon group and another acrylic monomer. Coating with such a resin can contribute to suppressing a reduction in charging ability in a hot and humid environment.

In the present invention, the resin to be put in the pores of the porous magnetic particles may be either a thermoplastic resin or a thermosetting resin. In view of a coating process for producing the magnetic carrier, a thermosetting resin which is not dissolved in a solvent that may be used in the coating process is preferred, and a silicone resin which is easy to be put in the pores is more preferred.

The specific resistance of the magnetic carrier of the present invention at a field intensity of 2000 V/cm can be in the range of $1.0\times10^7$ Ω·cm to $1.0\times10^{10}$ Ω·cm because such a specific resistance gives good developability.

A method for producing the magnetic carrier of the present invention will now be described.

Method for Producing Porous Magnetic Particles

The porous magnetic particles can be produced through the following processes.

The material of the porous magnetic particles can be magnetite or ferrite. Since use of ferrite enables the porous structure of the porous magnetic particles to be controlled and resistance to be adjusted, ferrite can be employed as the material of the porous magnetic particles.

Ferrite is a sinter represented by the following general formula:

$$(M1_2O)x(M2O)y(Fe_2O_3)z$$

(in the formula, M1 represents a monovalent metal; M2 represents a divalent metal; and assuming the relationship $x+y+z=1.0$, x and y satisfy the relationship $0\leq(x,y)\leq0.8$, and z satisfies the relationship $0.2<z<1.0$).

In the formula, M1 and M2 can be at least one metal atom selected from the group consisting of Li, Fe, Mn, Mg, Sr, Cu, Zn, and Ca.

In the magnetic carrier, magnetization needs to be appropriately maintained to adjust the pore size to be in a predetermined range and to allow the surfaces of the porous magnetic particles to have proper unevenness. In addition, easily controlling a rate of ferritization and suitably controlling the specific resistance and magnetic force of the porous magnetic particles are also needed. From such a viewpoint, ferrite containing an Mn element can be suitably used, such as Mn-ferrite, Mn—Mg ferrite, Mn—Mg—Sr ferrite, and Li—Mn ferrite.

Production processes in which ferrite is used as the material of the porous magnetic particles will now be described in detail.

First Process: Weighing and Mixing Process

Raw Materials of ferrite are weighed and mixed. Examples of the raw materials of ferrite include metal particles, oxides, hydroxides, carbonates, and oxalates of Li, Fe, Mn, Mg, Sr, Cu, Zn, and Ca. Use of hydroxides or carbonates as the raw materials is more likely to increase the pore volume than use of oxides. Examples of an apparatus used for mixing the raw materials include a ball mill, a planetary mill, a Giotto mill, and a vibrating mill. In particular, a ball mill can be employed in terms of mixing properties. Specifically, the weighed raw materials of ferrite and balls are put into a ball mill, and the raw materials are pulverized and mixed for at least 0.1 hour and up to 20.0 hours.

Second Process: Pre-Calcination Process

The pulverized and mixed materials of ferrite are formed into pellets with, for example, a pressure forming machine and then subjected to pre-calcination. Since pre-calcination is important to produce the magnetic carrier of the present invention, the pre-calcination is carried out under specific conditions. In an example of the pre-calcination process, the materials are subjected to pre-calcination at 1000° C. to 1100° C. for at least 3 hours and up to 5.0 hours to be converted into ferrite. In this case, the amount of the materials to be fed is appropriately adjusted so that ferritization is sufficiently advanced. The atmosphere can be adjusted to further promote ferritization; in particular, oxygen concentration is decreased by, for instance, introducing a nitrogen atmosphere. Examples of a furnace usable in the pre-calcination include a burner-equipped calcination furnace, a rotary calcination furnace, and an electric furnace.

Third Process: Pulverizing Process

The pre-calcined ferrite produced in the second process is pulverized with a pulverizer. Any pulverizer can be used provided that an intended particle size is obtained. Examples thereof include a crusher, a hammer mill, a ball mill, a bead mill, a planetary mill, and a Giotto mill. The degree of ferritization is greater in part of the calcined product used herein than in typical calcined product, and this calcined product therefore has a high hardness. Thus, the pulverization strength needs to be enhanced to obtain a predetermined particle size. It is important to enhance pulverization strength to control the particle size and particle size distribution of the finely pulverized product of the pre-calcined ferrite, thereby adjusting the particle size of the ferrite particles to be small and even.

Controlling the particle size and particle size distribution of the finely pulverized product has a correlation with the pore size of the porous magnetic particles and the degree of unevenness on the surface of the magnetic carrier.

In the case where, for example, a ball mill or a bead mill is used, the material of balls or beads and the length of operation time can be adjusted to control the particle size distribution of the finely pulverized product of the pre-calcined ferrite. In particular, in order to reduce the particle size of the calcined ferrite, balls having a heavy specific gravity may be used, or the time taken for the pulverization may be prolonged. The material of the balls or beads is not particularly limited provided that a predetermined particle size and an intended particle size distribution are obtained. Examples thereof include glasses such as soda-lime glass (specific gravity: 2.5 g/cm$^3$), soda-lime-free glass (specific gravity: 2.6 g/cm$^3$), and high-specific gravity glass (specific gravity: 2.7 g/cm$^3$); and quartz (specific gravity: 2.2 g/cm$^3$), titania (specific gravity: 3.9 g/cm$^3$), silicon nitride (specific gravity: 3.2 g/cm$^3$), alumina (specific gravity: 3.6 g/cm$^3$), zirconia (specific gravity: 6.0 g/cm$^3$), steel (specific gravity: 7.9 g/cm$^3$), and stainless steel (specific gravity: 8.0 g/cm$^3$). Among these, alumina, zirconia, and stainless steel have an excellent abrasion resistance and can therefore be employed. The balls or the beads have any particle size provided that a predetermined particle size and an intended particle size distribution are obtained. Balls, for example, each having a diameter ranging from 4 mm to 60 mm can be suitably used. Beads each having a diameter ranging from 0.03 mm to 5 mm can also be suitably used. In addition, a wet ball mill or a wet bead mill has higher efficiency of pulverization than a dry ball mill or a dry bead mill because a pulverized product does not fly in the mill. Hence, the wet-type mill can be employed rather than the dry-type mill.

Fourth Process: Granulating Process

A dispersant, water, a binder, and optionally a pore regulator may be added to the finely pulverized product of the pre-calcined ferrite. Examples of the pore regulator include a foaming agent and fine resin particles. The binder can be, for example, polyvinyl alcohol. In the case where the pre-calcined ferrite is pulverized with a wet-type mill in the third process, the binder and optionally the pore regulator can be added in view of water contained in ferrite slurry.

The resulting ferrite slurry is dried and granulated with a spray drying machine in a thermal environment at 100° C. to 200° C. Any spray drying machine can be used provided that a predetermined particle size is obtained; for example, a spray drier can be used.

Then, the granulated product is heated at 600° C. to 800° C. to thermally remove a dispersant and a binder.

Fifth Process: Calcination Process

In an electric furnace in which the oxygen concentration can be controlled, the product is calcined at 1000° C. to 1300° C. for at least 1 and up to 24 hours in an oxygen-controlled atmosphere. Adjustment of the temperature enables the pore volume to be controlled; for instance, increasing the temperature leads to a decrease in the pore volume. The pore volume of the porous magnetic particles can be in the range of 20.0 mm$^3$/g to 100.0 mm$^3$/g.

Even though the ferritization has been thoroughly advanced in the pre-calcination process, the length of time in which the temperature increase and decrease undergo the range of 700° C. to 1100° C. that is a temperature range for promoting ferritization is shortened to prevent ferritization from being induced by way of caution. The time for which the top temperature is maintained can be from three hours to five hours. In this case, a rotary electric furnace, a batch-type electric furnace, or a continuous electric furnace is used, and the oxygen concentration in the atmosphere during the calcination may be controlled by introducing an inert gas, such as nitrogen, or a reducing gas such as hydrogen or carbon monoxide. In the case where a rotary electric furnace is used, the atmosphere and the calcination temperature may be changed to carry out the calcination in multiple steps.

Sixth Process: Separation Process

The calcined particles are crushed, and then a low-magnetic product is optionally separated by magnetic separation. Coarse particles and fine particles may be removed by air classification or being filtered through a sieve.

Surface Treatment Process

The surfaces of the resulting particles are optionally heated at low temperature to be subjected to oxide coating, thereby adjusting the resistance. The heating for oxide coating can be carried out with a general rotary electric furnace or a batch-type electric furnace at, for example, 300° C. to 700° C.

The 50% particle size (D50) of the porous magnetic particles produced as described above is determined on the basis of the volume distribution; in order to adjust the particle size of the final magnetic carrier to be from 30.0 μm to 80.0 μm, the 50% particle size can be in the range of 28.0 μm to 78.0 μm. This enables toner to be well subjected to triboelectric charging, contributes to satisfying the image quality of a halftone portion, and enables a reduction in fogging and prevention of carrier adhesion.

The specific resistance of the porous magnetic particles at a field intensity of 300 V/cm can be in the range of $1.0\times10^7$ Ω·cm to $1.0\times10^9$ Ω·cm in the measurement of specific resistance which will be described later, so that developability is enhanced.

Method for Producing Resin-Filled Magnetic Core Particles

A technique which can be employed for putting a resin composition in the pores of the porous magnetic particles involves dissolving resin in a solvent, putting this solution to the pores of the porous magnetic particles, and removing the solvent. Any solvent which can dissolve the resin can be used. Examples of the solvent include organic solvents such as toluene, xylene, cellosolve butyl acetate, methyl ethyl ketone, methyl isobutyl ketone, and methanol. In an example of the technique which can be used for putting the resin in the pores of the porous magnetic particles, the porous magnetic particles are impregnated with a resin solution by an application technique, such as a dipping process, a spraying process, a brushing process, or a fluidized bed process; and then the solvent is volatilized.

A dipping process can involve introducing a solution of a resin composition in a solvent into the pores of the porous magnetic particles under reduced pressure and then removing the solvent by degassing or heating.

In the present invention, the time taken for degassing can be adjusted to control a rate at which the solvent is removed, thereby controlling the penetration of the resin composition into the pores of the porous magnetic particle. The applied resin penetrates into the pores by a capillary phenomenon; hence, the longer the time is taken, the more the resin penetrates into the porous magnetic particles.

After the resin composition is put in the pores, the resulting product is optionally heated by any technique to allow the resin composition to tightly adhere to the porous magnetic particles. The heating may be either external heating or internal heating; for instance, a fixed or movable electric furnace, a rotary electric furnace, or a burner-equipped furnace may be used, or firing with a microwave may be carried out.

In terms of putting the solution of the resin composition in the pores and time taken for removing the solvent, the resin solid content in the solution of the resin composition can be in the range of 6 mass % to 50 mass % because the viscosity of the solution of the resin composition is appropriate.

The resin contained in the resin composition that is to be put in the pores of the porous magnetic particles is not particularly limited; however, a resin which can well penetrate is suitably employed. In the case where a resin which can well penetrate is applied, the resin primarily penetrates into the pores formed in the porous magnetic particles, and the pores therefore remain in the vicinity of the surfaces of the resin-filled magnetic core particles; thus, the surfaces of the resin-filled magnetic core particles have an unevenness reflecting the shape of the pores. Accordingly, such a resin which can well penetrate is suitably employed in terms of the surface tension of a coating resin composition.

The resin contained in the resin composition may be either a thermoplastic resin or a thermosetting resin; in view of a coating process for producing the magnetic carrier, a thermosetting resin which is not dissolved in a solvent that may be used in the coating process is preferred, and a silicone resin which is easy to be put in the pores is more preferred. Examples of commercially available products of such a resin include straight silicone resins such as KR-271, KR-251, and KR-255 manufactured by Shin-Etsu Chemical Co., Ltd. and SR2400, SR2405, SR2410, and SR2411 manufactured by Dow Corning Toray Co., Ltd.; and modified silicone resins such as KR206 (alkyd-modified), KR5208 (acryl-modified), ES1001N (epoxy-modified), and SR2110 (alkyd-modified) manufactured by Shin-Etsu Chemical Co., Ltd.

The resin composition put in the pores can contain a silane coupling agent. The silane coupling agent has a good compatibility with the resin, and thus the wettability and adhesiveness of the resin to the porous magnetic particles are enhanced. Hence, the resin primarily penetrates into the pores formed in the porous magnetic particles. As a result, the surfaces of the resin-filled magnetic core particles have an unevenness reflecting the shape of the pores. Thus, such a resin composition containing a silane coupling agent can be employed in view of the surface tension of the coating resin composition.

Any silane coupling agent can be used; however, an aminosilane coupling agent can be employed because a functional group present therein enables an affinity for the coating resin composition to be improved.

It is believed that the aminosilane coupling agent serves to enhance the wettability and adhesiveness of the resin to the porous magnetic particles and to improve affinity for the coating resin composition as follows. The aminosilane coupling agent has a portion reactive with an inorganic substance and a portion reactive with an organic substance; in general, the alkoxy group reacts with the inorganic substance, and the functional group having an amino group reacts with the organic substance. Accordingly, the alkoxy group of the aminosilane coupling agent reacts with the porous magnetic particles to enhance the wettability and the adhesiveness, and the functional group having the amino group is oriented toward the resin to improve the affinity for the coating resin composition.

The amount of the silane coupling agent to be added can be in the range of 1.0 part by mass to 20.0 parts by mass relative to 100 parts by mass of the resin. The amount of the silane coupling agent to be added can be from 5.0 parts by mass to 10.0 parts by mass to further enhance the wettability and adhesiveness of the resin to the porous magnetic particles.

Method for Producing Magnetic Carrier

The surfaces of the resin-filled magnetic core particles can be coated with a coating resin composition by any technique, and examples of a usable coating technique include a dipping process, a spraying process, a brushing process, a dry process, and a fluidized bed process. Among these, in view of the effect of the unevenness specific to the surfaces of the porous magnetic particles, a dipping technique which enables adjustment of the proportion of the thin part of the coating layer to the thick part can be employed, so that developability can be enhanced. It is presumed that the mechanism of the enhancement in developability is as follows. Owing to the unevenness on the surfaces of the porous magnetic particles, the layer of the coating resin composition has both thin part and thick part; hence, the locally present thin part serves for charge relaxation.

A solution of a coating resin composition used for coating the resin-filled magnetic core particles can be prepared as in the preparation of the solution of the resin to be put in the pores. Granulation in the coating process can be reduced by, for example, adjusting the resin concentration in the solution of the coating resin composition, the internal temperature of an apparatus used for the coating, temperature and the degree of pressure reduction in removal of the solvent, and the number of the coating processes.

The resin contained in the coating resin composition used for forming the coating layer is not particularly limited; however, the resin can be an acrylic resin which is a copolymer of an acrylic monomer having a molecular structure containing a cyclic hydrocarbon group and another acrylic monomer. Coating with such an acrylic resin can contribute to suppressing a reduction in the amount of electrification in a hot and humid environment.

It is believed that coating with the acrylic resin can contribute to suppressing a reduction in the amount of electrification in a hot and humid environment by the following mechanism. The resin-filled magnetic core particles are coated with the above-mentioned acrylic resin through a coating process in which a solution of the acrylic resin in an organic solvent is mixed with the resin-filled magnetic core particles and in which the solvent is then removed. In this process, the solvent is removed in a state in which cyclic hydrocarbon groups are oriented to the surface of the coating resin layer, and the coating resin layer is present on the surface of the completed magnetic carrier in a state in which highly hydrophobic cyclic hydrocarbon groups have been oriented.

Specific examples of the cyclic hydrocarbon groups include cyclic hydrocarbon groups having 3 to 10 carbon atoms, such as a cyclohexyl group, a cyclopentyl group, an adamantyl group, a cyclopropyl group, a cyclobutyl group, a cycloheptyl group, a cyclooctyl group, a cyclononyl group, a cyclodecyl group, an isobornyl group, a norbornyl group, and a boronyl group. Among these, a cyclohexyl group, a cyclopentyl group, and an adamantyl group are preferred, and a cyclohexyl group is especially preferred because it has a structural stability and thus tightly adheres to the resin-filled magnetic core particles.

In order to adjust the glass transition temperature (Tg), another monomer may be used as an additional component of the acrylic resin.

Such a monomer which may be used as an additional component of the acrylic resin can be a known monomer, and examples thereof include styrene, ethylene, propylene, butylene, butadiene, vinyl chloride, vinylidene chloride, vinyl acetate, methyl methacrylate, ethyl methacrylate, propyl methacrylate, vinyl methyl ether, vinyl ethyl ether, and vinyl methyl ketone.

The acrylic resin used for forming the coating layer can be a graft polymer because the wettability of the acrylic resin to the porous magnetic particles is improved with the result that an even coating film can be formed.

A graft polymer can be produced by a technique which involves forming the main chain and then performing graft polymerization or by a technique which involves using a macromonomer as a monomer for copolymerization. The technique which involves using a macromonomer as a monomer for copolymerization can be more suitably used because the molecular weight of a branched chain can be easily controlled.

Any macromonomer can be used; however, in view of improvement of the wettability of the acrylic resin to the porous magnetic particles, a methyl methacrylate macromonomer can be employed.

The amount of the macromonomer used for polymerization is preferably in the range of 10 parts by mass to 50 parts by mass, and more preferably 20 parts by mass to 40 parts by mass relative to 100 parts by mass of a copolymer having the main chain that is the acrylic resin.

The coating resin composition may contain conductive particles or particles or materials having charge controlling properties. Examples of the conductive particles include carbon black, magnetite, graphite, zinc oxide, and tin oxide. In particular, in the case where the filler effect of carbon black is suitably utilized, the surface tension of the coating resin composition can properly work, and the coating properties of the coating resin composition are therefore improved; thus, carbon black can be employed.

In this case, improvement of the coating properties of the coating resin composition, which is brought about by proper utilization of the filler effect of carbon black, can be attributed to the primary particle size and cohesive properties of the carbon black. In particular, since the primary particle size of carbon black is small, its specific surface area is large. In addition, carbon black is highly cohesive and thus in the form of agglomerated particles that are large particles. Owing to such a primary particle size and cohesive properties, carbon black can be particles that are largely out of the relationship between the particle size and the specific surface area. Specifically, the particle size of carbon black enables the surface tension of the coating resin composition to affect the carbon black, and the carbon black has a large contact point owing to its large specific surface area; thus, the surface tension of the coating resin composition easily affects carbon black.

The amount of the conductive particles can be from 0.1 part by mass to 10.0 parts by mass relative to 100 parts by mass of the coating resin in order to adjust the resistance of the magnetic carrier. Examples of the particles having charge controlling properties include particles of an organic metal complex, particles of an organic metal salt, particles of a chelate compound, particles of a monoazo metal complex, particles of an acetylacetone metal complex, particles of a hydroxycarboxylic acid metal complex, particles of a polycarboxylic acid metal complex, particles of a polyol metal complex, particles of a polymethyl methacrylate resin, particles of a polystyrene resin, particles of a melamine resin, particles of a phenol resin, particles of a nylon resin, particles of silica, particles of titanium oxide, and particles of alumina. The amount of the particles having charge controlling properties can be in the range of 0.5 parts by mass to 50.0 parts by mass relative to 100 parts by mass of the coating resin in order to adjust the degree of triboelectric charging.

The specific resistance of the magnetic carrier of the present invention, which can be measured as described below, at a field intensity of 2000 V/cm can be in the range of $1.0\times10^{7}$ Ω·cm to $1.0\times10^{10}$ Ω·cm because such a specific resistance enables requirements for both a blank dot and the developability of an halftone image to be satisfied.

The true density of the magnetic carrier of the present invention can be in the range of 3.0 g/cm$^3$ to 4.5 g/cm$^3$. A two-component developer containing the magnetic carrier having such a true density has a small load on toner, and the adhesion of components of the toner to the magnetic carrier is reduced. The true density of the magnetic carrier can be in such a range also in order to enable both good developability and prevention of carrier adhesion at low field intensity.

The apparent density of the magnetic carrier of the present invention can be in the range of 1.7 g/cm$^3$ to 2.2 g/cm$^3$. A two-component developer containing the magnetic carrier having such an apparent density has a small load on toner, and the adhesion of components of the toner to the magnetic carrier is reduced. The apparent density of the magnetic carrier can be in such a range also in order to enable both good developability and prevention of carrier adhesion at low field intensity.

The toner suitably used in the present invention will now be described in detail.

Examples of a binder resin used in the present invention include vinyl resins, polyester resins, and epoxy resins. Of these, vinyl resins and polyester resins can be employed in terms of chargeability and fixing properties. In particular, use of polyester resins provides large advantageous effects.

In the present invention, the binder resin may be optionally mixed with other materials such as homopolymers and copolymers of vinyl monomers, polyester, polyurethane, epoxy resins, polyvinyl butyral, rosin, modified rosin, terpene resins, phenolic resins, aliphatic and alicyclic hydrocarbon resins, and aromatic petroleum resins.

In the case where two or more resins are mixed with each other and used as the binder resin, resins having different molecular weights can be employed and mixed at an appropriate mixing ratio.

The glass transition temperature of the binder resin is preferably in the range of 45° C. to 80° C., and more preferably 55° C. to 70° C.; the number average molecular weight (Mn)

thereof is preferably in the range of 2,500 to 50,000; and the weight average molecular weight (Mw) is preferably in the range of 10,000 to 1,000,000.

The binder resin also can be the following polyester resin.

The polyester resin contains 45 mol % to 55 mol % of an alcohol component and 55 mol % to 45 mol % of an acid component relative to all of the components.

The acid value of the polyester resin is preferably not more than 90 mgKOH/g, and more preferably not more than 50 mgKOH/g; and the OH value thereof is preferably not more than 50 mgKOH/g, and more preferably not more than 30 mgKOH/g. This is because an increase in the number of terminal groups of molecular chains enhances the environmental dependence of charging characteristics of the toner.

The glass transition temperature of the polyester resin is preferably in the range of 50° C. to 75° C., and more preferably 55° C. to 65° C. The number average molecular weight (Mn) of the polyester resin is preferably in the range of 1,500 to 50,000, and more preferably 2,000 to 20,000. The weight average molecular weight (Mw) of the polyester resin is preferably in the range of 6,000 to 100,000, and more preferably 10,000 to 90,000.

In the case where the toner used in the present invention is magnetic toner, examples of a magnetic material contained in the magnetic toner include iron oxides such as magnetite, maghemite, and ferrite; iron oxides containing other metal oxides; metals such as Fe, Co, and Ni; alloys of these metals with other metals such as Al, Co, Cu, Pb, Mg, Ni, Sn, Zn, Sb, Be, Bi, Cd, Ca, Mn, Se, Ti, W, and V; and mixtures thereof.

Specific examples of the magnetic material include triiron tetraoxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), an iron powder (Fe), a cobalt powder (Co), and a nickel powder (Ni).

In the case where the magnetic material is used, the amount thereof is preferably in the range of 20 parts by mass to 150 parts by mass, more preferably 50 parts by mass to 130 parts by mass, and further preferably 60 parts by mass to 120 parts by mass relative to 100 parts by mass of the binder resin.

A nonmagnetic colorant used in the present invention can be the following materials.

Examples of a black colorant include carbon black and black materials prepared by mixing a yellow colorant, a magenta colorant, and a cyan colorant with each other.

Examples of a color pigment used for a magenta toner include condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples thereof include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, and 269; C.I. Pigment violet 19; and C.I. Vat Red 1, 2, 10, 13, 15, 23, 29, and 35.

The pigment may be used alone as the colorant; however, the pigment can be properly used in combination with a dye to make the color more sharp, which can improve the quality of a full-color image.

Examples of a dye used for a magenta toner include oil-soluble dyes such as C.I Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40 and C.I. Basic Violet 1, 3, 7, 10, 14, 15, 21, 25, 26, 27, and 28.

Examples of a color pigment used for a cyan toner include C.I. Pigment Blue 1, 2, 3, 7, 15:2, 15:3, 15:4, 16, 17, 60, 62, and 66; C.I. Vat Blue 6; C.I. Acid Blue 45; and a copper phthalocyanine pigment having a phthalocyanine skeleton to which one to five phthalimidomethyl groups have been introduced.

Examples of a color pigment used for a yellow toner include condensed azo compounds, isoindolinone compounds, anthraquinone compounds, azo metal compounds, methine compounds, and arylamide compounds. Specific examples thereof include C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191; and C.I. Vat Yellow 1, 3, and 20. Furthermore, dyes, such as C.I. Direct Green 6, C.I. Basic Green 4, C.I. Basic Green 6, and C.I. Solvent Yellow 162 may also be used.

The amount of the colorant is preferably in the range of 0.1 part by mass to 30 parts by mass, more preferably 0.5 parts by mass to 20 parts by mass, and most preferably 3 parts by mass to 15 parts by mass relative to 100 parts by mass of the binder resin.

In the toner, the binder resin can be preliminarily mixed with the colorant into a masterbatch. The masterbatch containing the colorant can be melt-kneaded with other materials (e.g., binder resin and wax) to properly disperse the colorant in the toner.

The toner used in the present invention can optionally contain a charge control agent to make its chargeability more stable. The amount of the charge control agent can be from 0.5 parts by mass to 10 parts by mass relative to 100 parts by mass of the binder resin.

The charge control agent may be the following materials.

A negative charge control agent that allows the toner to be negatively chargeable can be used; for instance, organometallic complexes and chelate compounds are effective. Examples thereof include monoazo metal complexes, metal complexes of aromatic hydroxycarboxylic acids, and metal complexes of aromatic dicarboxylic acids. Other examples thereof include aromatic hydroxycarboxylic acids; aromatic mono- and polycarboxylic acids, metal salts thereof, anhydrides thereof, and esters thereof; and phenol derivatives of bisphenols.

A positive charge control agent that allows the toner to be positively chargeable can be used. Examples thereof include nigrosine and its modified products by metal salts of fatty acids; quaternary ammonium salts such as tributylbenzylammonium-1-hydroxy-4-naphtholsulfonate and tetrabutylammonium tetrafluoroborate; onium salts such as phosphonium salts, which are analogs thereof; chelate pigments thereof, such as triphenylmethane dyes, and lake pigments thereof (examples of a laking agent include phosphotungstic acid, phosphomolybdic acid, phosphotungstomolybdic acid, tannic acid, lauric acid, gallic acid, ferricyanic acid, and ferrocyanides); and metal salts of higher fatty acids, such as diorganotin oxides, e.g., dibutyltin oxide, dioctyltin oxide, and dicyclohexyltin oxide, and diorganotin borates, e.g., dibutyltin borate, dioctyltin borate, and dicyclohexyltin borate.

In the present invention, the toner particles may optionally contain one or more release agents. The release agent may be the following materials.

Aliphatic hydrocarbon waxes can be used, such as low-molecular-weight polyethylene, low-molecular-weight polypropylene, microcrystalline wax, and paraffin wax. Other examples of the release agent include oxides of aliphatic hydrocarbon wax, such as oxidized polyethylene wax, and block copolymers thereof; waxes mainly containing fatty acid esters, such as carnauba wax, Sasolwax, and montan wax; and compounds prepared by partially or entirely deoxidizing fatty acid esters, such as deoxidized carnauba wax.

The amount of the release agent is preferably in the range of 0.1 part by mass to 20 parts by mass, and more preferably 0.5 parts by mass to 10 parts by mass relative to 100 parts by mass of the binder resin.

The melting point of the release agent is measured by differential scanning calorimetry (DSC) and defined by the temperature at the maximum endothermic peak obtained in heating; the melting point is preferably in the range of 65° C. to 130° C., and more preferably 80° C. to 125° C. At a melting point satisfying such a range, the release agent can effectively reduce the adhesion of the toner to a photosensitive member while low-temperature fixing properties are maintained; hence, such a melting point is suitable.

The toner used in the present invention may contain a fluidity improver that is fine powder which is externally added to the toner particles to enhance the fluidity of the toner particles. Examples of the fluidity improver which can be particularly employed include fluorine-based resin powder, such as a vinylidene fluoride fine powder and a polytetrafluoroethylene fine powder; fine silica powder such as silica powder prepared by a wet process or a dry process; and materials which are prepared by subjecting fine titanium oxide powder or fine alumina powder to hydrophobic treatment by a surface treatment with a silane coupling agent, a titanium coupling agent, or silicone oil and of which the degree of hydrophobicity measured by methanol titration is in the range of 30 to 80.

The amount of the inorganic fine particles used in the present invention is from 0.1 part by mass to 10 parts by mass, and preferably 0.2 parts by mass to 8 parts by mass relative to 100 parts by mass of the toner.

In the case where the toner used in the present invention is mixed with the magnetic carrier into a two-component developer, the mixing ratio is adjusted such that the concentration of the toner in the developer is in the range of 2 mass % to 15 mass %, and preferably 4 mass % to 13 mass %, which is likely to produce good results.

A developer for replenishment is fed to a developing device when the concentration of the toner in the two-component developer in the developing device has decreased; in the developer for replenishment, the amount of the toner is in the range of 2 parts by mass to 50 parts by mass relative to 1 part by mass of the magnetic carrier contained in the developer for replenishment.

Although the image forming method of the present invention will now be described with reference to an example of an image forming apparatus including a developing device in which the magnetic carrier, two-component developer, and developer for replenishment according to the present invention are used, a developing device used in the image forming method of the present invention is not limited thereto.

Image Forming Method

Figure 2:
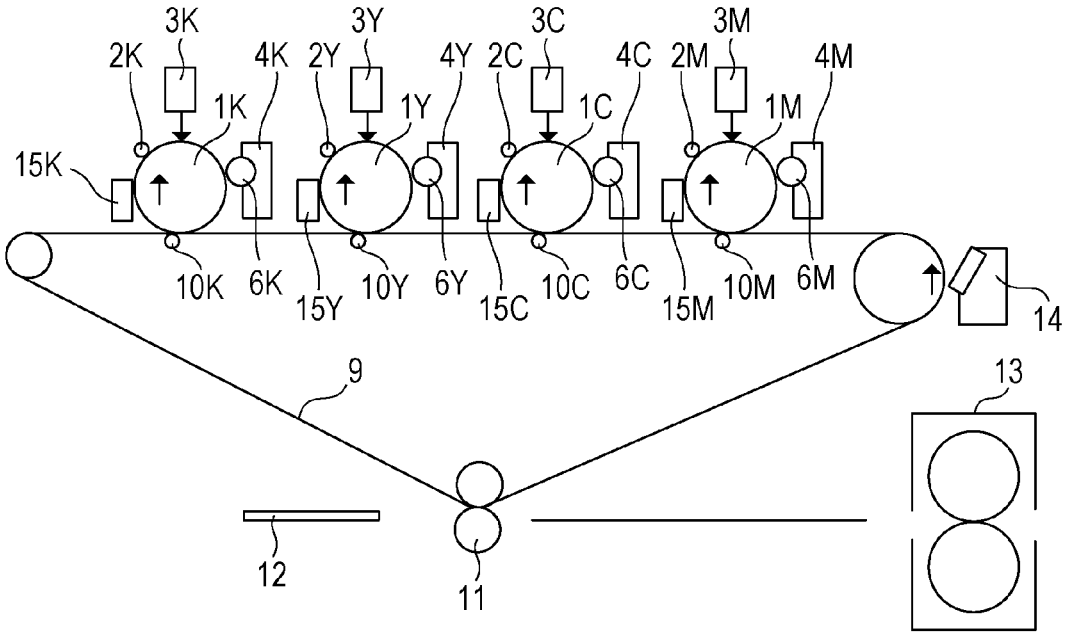
FIG. 2 schematically illustrates an image forming apparatus used in an embodiment of the present invention.

In FIG. 1, an electrostatic latent image-bearing member 1 is rotated in a direction indicated by an arrow. The electrostatic latent image-bearing member 1 is charged by a charger 2 that is a charging unit, and the surface of the charged electrostatic latent image-bearing member 1 is exposed to light emitted from an exposure device 3 that is an electrostatic latent image-forming unit, thereby forming an electrostatic latent image. A developing device 4 has a developer container 5 which accommodates the two-component developer, a developer-bearing member 6 is disposed so as to be rotatable, and magnets 7 that are magnetic field generators are disposed inside the developer-bearing member 6. The magnets 7 are provided such that at least one of them faces the electrostatic latent image-bearing member 1. A magnetic field generated by the magnets 7 enables the two-component developer to be supported on the developer-bearing member 6, the amount of the supported two-component developer is regulated by a regulating member 8, and the two-component developer is conveyed to a developing portion which faces the electrostatic latent image-bearing member 1. In the developing portion, the magnetic field generated by the magnets 7 forms a magnetic brush. Then, a developing bias in which an alternating electric field is superimposed on a direct electric field is applied to form the electrostatic latent image into a visible toner image. The toner image formed on the electrostatic latent image-bearing member 1 is electrostatically transferred to a recording medium 12 (transfer material) by a transfer charger 11. In this case, as illustrated in FIG. 2, the toner image may be temporarily transferred from the electrostatic latent image-bearing member 1 to an intermediate transfer member 9 and then electrostatically transferred to the recording medium 12. Then, the recording medium 12 is transported to a fixing device 13 to be heated and pressed, thereby fixing the toner onto the recording medium 12. The recording medium 12 on which an output image has been formed is subsequently ejected to the outside of the apparatus. After the transfer step, toner remaining on the electrostatic latent image-carrier 1 is removed by a cleaner 15. Then, the electrostatic latent image-bearing member 1 from which the residual toner has been removed by the cleaner 15 is electrically initialized by being irradiated with light emitted from a pre-exposure device 16, and then this image forming process is continued.

FIG. 2 schematically illustrates an example of a full-color image forming apparatus to which the image forming method of the present invention has been applied.

The arrangement of image forming units K, Y, C, and M and a rotational direction indicated by arrows in FIG. 2 are not limited by illustration in FIG. 2. Meanwhile, K, Y, C, and M refer to black, yellow, cyan, and magenta, respectively. Electrostatic latent image-bearing members 1K, 1Y, 1C, and 1M illustrated in FIG. 2 are rotated in a direction indicated by arrows. The electrostatic latent image-bearing members 1K, 1Y, 1C, and 1M are charged by chargers 2K, 2Y, 2C, and 2M that are charging units, and the surfaces of the charged electrostatic latent image-bearing members 1K, 1Y, 1C, and 1M are exposed to light emitted from exposure devices 3K, 3Y, 3C, and 3M that are electrostatic latent image-forming units, respectively, thereby forming electrostatic latent images. Developing devices 4K, 4Y, 4C, and 4M which are developing units include developer-bearing members 6K, 6Y, 6C, and 6M on which the two-component developers are supported, respectively, and the electrostatic latent images are formed into visual toner images by the two-component developers. The toner images are transferred to the intermediate transfer member 9 by intermediate transfer chargers 10K, 10Y, 10C, and 10M that are transfer units. Then, the resulting toner images are transferred to the recording medium 12 by the transfer charger 11 which are also the transfer units, the transfer medium 12 is heated and pressed by the fixing device 13, which is a fixing unit, to fix the transferred images, and then the recording medium 12 having a completed image is ejected. An intermediate transfer medium cleaner 14 which is a cleaner for cleaning the intermediate transfer member 9 retrieves, for example, residual toner. In a specific development process in the present invention, while alternating voltage is applied to the developer-bearing member 6 to form an alternating electric field in a region to be subjected to development, development can be carried out in a state in which the magnetic brush is in contact with the photosensitive member. The distance between the developer-bearing member (developing sleeve) 6 and the photosensitive drum (distance S-D) is desirably in the range of 100 μm to 1000 μm to prevent carrier adhesion and to enhance dot reproducibility.

The peak-to-peak voltage (Vpp) of the alternating electric field is in the range of 300 V to 3000 V, and preferably 500 V to 1800 V. The frequency thereof is in the range of 500 Hz to 10000 Hz, and preferably 1000 Hz to 7000 Hz. The peak-to-peak voltage and frequency can be appropriately determined depending on the process. In this case, the waveform of an alternating bias for forming an alternating electric field may be a triangular wave, a rectangular wave, a sine wave, or a waveform obtained by changing a duty ratio. In order to cope with a change in a rate at which a toner image is formed, development can be carried out by applying a developing bias voltage (intermittent superimposed alternating voltage) having a discontinuous alternating bias voltage to the developer-bearing member.

Use of a two-component developer containing a properly charged toner enables a fog removal voltage (Vback) to be at a lower level, and the degree of the primary charging of the photosensitive member can be therefore reduced; hence, the lifetime of the photosensitive member can be prolonged. The Vback is, depending on a developing system, not more than 200 V, and preferably not more than 150 V. A contrast potential can be in the range of 100 V to 400 V to form an image having a sufficient image density.

If the frequency is in the range described above, depending on a processing speed, the structure of the electrostatic latent image-bearing member may be the same as that of a photosensitive member used in general image forming apparatuses. An example of such an electrostatic latent image-bearing member is a photosensitive member having a structure in which a conductive layer, an undercoat layer, a charge-generating layer, a charge-transporting layer, and optionally a charge-injecting layer are formed in sequence on a conductive substrate made of, for instance, aluminum or stainless steel (SUS).

The conductive layer, the undercoat layer, the charge-generating layer, and the charge-transporting layer may each have a structure used for general photosensitive members. The outermost layer of the photosensitive member may be, for example, a charge-injecting layer or a protective layer.

Measurement of Specific Resistance of Magnetic Carrier and Porous Magnetic Particle The specific resistance of the magnetic carrier and porous magnetic particles is measured with a measuring apparatus schematically illustrated in FIG. 3. The specific resistance of the magnetic carrier is measured at a field intensity of 2000 (V/cm), and the specific resistance of the porous magnetic particles is measured at a field intensity of 300 (V/cm).

Figure 3A:
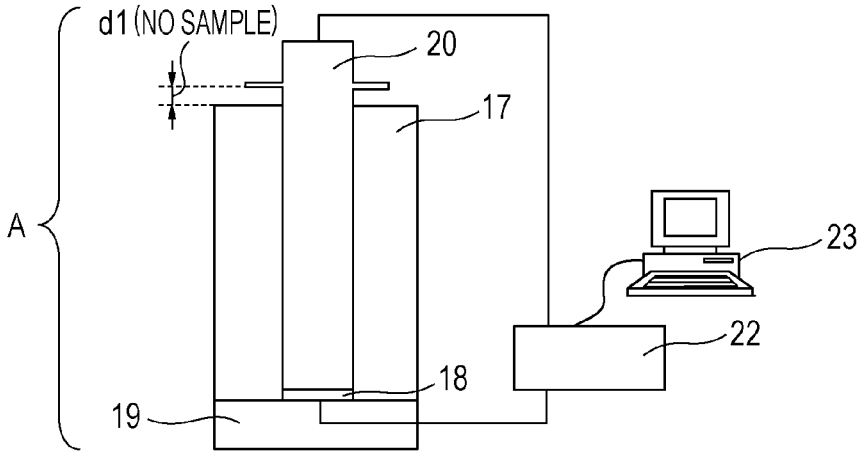
FIGS. 3A and 3B each schematically illustrate a system used for measuring the specific gravity of porous magnetic particles and magnetic carrier used in an embodiment of the present invention.
Figure 3B:
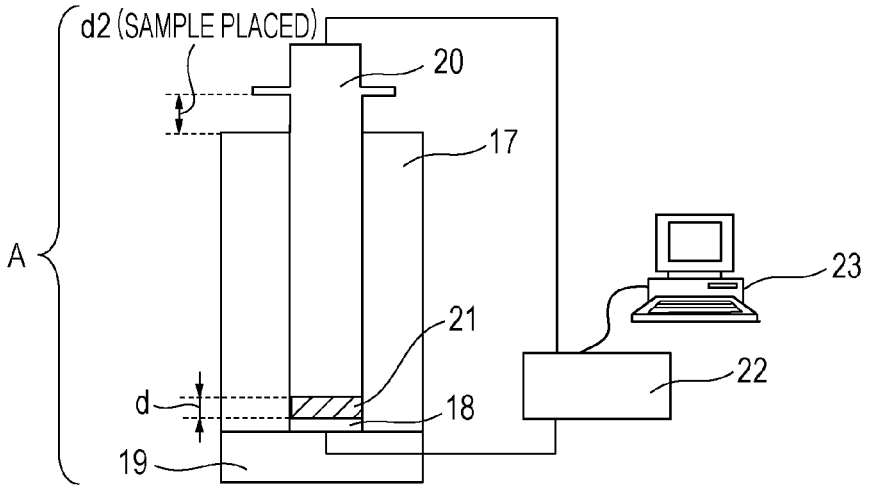

A resistance measuring cell A includes a cylindrical container 17 [made of polytetrafluoroethylene (PTFE) resin] having a cross sectional area of 2.4 $cm^2$ and having an opening, a lower electrode 18 (made of stainless steel), a supporting base 19 (made of PTFE resin), and an upper electrode 20 (made of stainless steel). The cylindrical container 17 and lower electrode 18 are put on the supporting base 19, and a sample 21 (magnetic carrier or porous magnetic particles) is placed thereon so as to have a thickness of approximately 1 mm, and the upper electrode 20 is put on the sample 21 to measure the actual thickness of the sample 21. The distance d1 is defined as illustrated in FIG. 3A in a state in which no sample has been placed, and the distance d2 is defined as illustrated in FIG. 3B in a state in which a sample has been placed so as to have a thickness of approximately 1 mm; then, the thickness d of the sample is determined from the following equation.

$$d=d2-d1\,(\mathrm{mm})$$

In this case, the mass of a sample is appropriately changed such that the thickness d of the sample is in the range of 0.95 mm to 1.04 mm.

Direct voltage is applied between the electrodes, and an electric current flowing during the application of voltage can be measured to determine the specific resistance of the sample. The measurement is carried out with an electrometer 22 (Keithley 6517A manufactured by Keithley Instruments Inc.), and a processing computer 23 is used for control.

In the processing computer 23 used for control, a controlling system (manufactured by National Instruments Corporation) and controlling software (LabVIEW manufactured by National Instruments Corporation) are used.

The contact area S in which a sample contacts the electrodes is 2.4 $cm^2$, and the contact area S and the measured thickness d of the sample, which is in the range of 0.95 mm to 1.04 mm, are input as measurement conditions. In this case, the load of the upper electrode is 270 g, and the maximum voltage to be applied is 1000 V.

$$\text{Specific Resistance}(\Omega\cdot\text{cm})=(\text{Applied Voltage}(V)/\text{Measured Electric Current}(A))\times S(\text{cm}^2)/d(\text{cm})$$

$$\text{Electric Intensity}(V/\text{cm})=\text{Applied Voltage}(V)/d(\text{cm})$$

The specific resistance of the magnetic carrier or porous magnetic particles at the above-mentioned field intensity is obtained from a graph at a corresponding field intensity.

Measurement of 50% Particle Size (D50) of Magnetic Carrier and Porous Magnetic Particles on Volume Basis Particle size distribution is obtained with a particle size distribution analyzer "Microtrac MT3300EX" (manufactured by NIKKISO CO., LTD.) of a laser diffraction/scattering system.

In measurement of the 50% particle sizes (D50) of the magnetic carrier and porous magnetic particles on a volume basis, a sample-delivering machine "one-shot dry-type sample conditioner Turbotrac" (manufactured by NIKKISO CO., LTD.) used for dry measurement is attached to the analyzer. The conditions under which the Turbotrac delivers a sample are as follows: a dust collector is used as a vacuum source, the airflow rate is approximately 33 L/sec, and the pressure is approximately 17 kPa. The machine is automatically controlled with software. The particle size to be obtained is a 50% particle size (D50) in a particle size distribution on a volume basis. The control and the analysis are performed with software included in the machine (version 10.3.3-202D). The measurement conditions are as described below.

Set Zero time: 10 seconds
Measurement time: 10 seconds
Number of times of measurement: 1
Refractive index of particles: 1.81%
Particle shape: non-spherical Upper limit in measurement: 1408 μm
Lower limit in measurement: 0.243 μm
Measurement environment: 23° C., 50% RH Measurement of Pore Size and Pore Volume of Porous Magnetic Particles The pore size distribution of the porous magnetic particles is obtained by a mercury press-in method.

The measurement principle is as follows.

In the measurement, a pressure to be applied to mercury is changed, and the amount of mercury that intrudes into pores is measured at every pressure change. The condition under which mercury can intrude into the pores can be represented by the equation $PD=-4\sigma(\cos\theta)$ in which the equilibrium of force is taken into consideration, where P represents pressure, D represents the diameter of the pores, and θ and σ represent the contact angle and surface tension of mercury, respectively. When the contact angle and the surface tension are constants, the pressure P is in inverse proportion to the diameter D of the pores into which mercury can intrude at this pressure P. In view of the foregoing, the relationship between the pressure P and the amount V of liquid which can intrude at the pressure P is analyzed at various pressure levels to obtain a P-V curve, and the horizontal axis P of the P-V curve is replaced by the diameter of the pores on the basis of the equation to determine a pore size distribution.

The measurement can be carried out with a measuring apparatus such as a fully automatic multifunctional mercury porosimeter PoreMaster series/PoreMaster-GT series manufactured by YUASA IONICS or an automatic porosimeter AutoPore IV9500 series manufactured by SHIMADZU CORPORATION.

In particular, the measurement is carried out with AutoPore IV9520 series manufactured by SHIMADZU CORPORATION under the following conditions through the following procedures.

Measurement Conditions
Temperature: 20° C.
Measurement cell: sample volume of 5 $cm^3$, press-in volume of 1.1 $cm^3$, application mode of "powder", measurement range from 2.0 psia (13.8 kPa) to 59989.6 psia (413.7 kPa)
Measurement step: 80 steps (when the pore size is expressed on a logarithmic scale, steps are provided at equal intervals)
Press-In Parameter
Exhaust pressure: 50 μmHg
Exhaust time: 5.0 minutes
Mercury press-in pressure: 2.0 psia (13.8 kPa)
Equilibrium time: 5 seconds
High-Pressure Parameter
Equilibrium time: 5 seconds
Mercury Parameter
Advancing contact angle: 130.0 degrees
Receding contact angle: 130.0 degrees
Surface tension: 485.0 mN/m (485.0 dynes/cm)
Mercury density: 13.5335 g/mL Measurement Procedures (1) Approximately 1.0 g of the porous magnetic core particles are weighted and put in a sample cell. The weighed amount is input.

(2) The amount of mercury which has intruded is measured at a low-pressure portion in the range of 2.0 psia (13.8 kPa) to 45.8 psia (315.6 kPa).

(3) The amount of mercury which has intruded is measured at a high-pressure portion in the range of 45.9 psia (316.3 kPa) to 59989.6 psia (413.6 kPa).

(4) Pore size distribution is calculated from the pressure at which the mercury has intruded and the amount of the mercury.

The procedures (2), (3), and (4) are automatically carried out with software included in the measuring apparatus.

Within the pore size ranging from 0.1 μm to 3.0 μm in the pore size distribution obtained in this manner, the pore size in which the differential pore volume is maximum is determined, and the determined pore size is defined as the peak pore size used in the present invention.

The pore volume which can be obtained by integrating the differential volume of the pores having a size ranging from 0.1 μm to 3.0 μm is calculated with software included in the measuring apparatus.

Measurement of Surface Roughness Ra of Magnetic Carrier and Porous Magnetic Particles In the present invention, the measurement is carried out with a non-contact three-dimensional surface analyzer (Micromap 123 manufactured by Ryoka Systems Inc.). This analyzer is a highly precise laser microscope and can convert the surface roughness of an observed surface into a three-dimensional image. A specific example of the measurement is as follows.

A 20-power two-beam interference objective lens is attached to an optical microscope of the Microcap. The magnetic carrier or the porous magnetic particles are placed below the lens, and the interference figure is vertically scanned with a charge-coupled device (CCD) camera in a Wave mode to obtain the image of the surface structure of the magnetic carrier or porous magnetic particles in the form of a three-dimensional image. In the obtained image, the surface roughness Ra of the cross section at the section line is measured with analytical software (SX-Viewer manufactured by Ryoka Systems Inc.) included in the analyzer. In order to obtain the surface roughness Ra, the absolute values of deviations from the mean line to the profile curve in the evaluative length are added up and averaged. In the present invention, in order to eliminate an effect of curvature on the unevenness on the surface of the magnetic carrier or porous magnetic particles as much as possible, the surface roughness Ra is calculated under the following conditions: cut length of 24 μm, evaluative length of 8 μm, and cut-off value of 8 μm, and aligning the center of the magnetic carrier or porous magnetic particles in the three-dimensional image with the middle point of the section line. In the present invention, 50 magnetic carrier particles or porous magnetic particles are subjected to the measurement, and the average of results of the measurement is defined as the surface roughness Ra.

Measurement of Apparent Density of Magnetic Carrier

The apparent density of the magnetic carrier is determined in accordance with JIS-Z 2504 (Metallic powders-Determination of apparent density) in which the magnetic carrier replaces metallic powder.

Measurement of True Density of Magnetic Carrier

The true density of the magnetic carrier is measured with an automated dry density analyzer Accupyc 1330 (manufactured by SHIMADZU CORPORATION). A sample is left to stand at 23° C. and 50% RH for 24 hours, 5 g of the sample is precisely weighed and put into a measurement cell (10 $cm^3$), and then the measurement cell is inserted into the sample chamber of the analyzer. The true density can be automatically measured by inputting the mass of the sample into the analyzer and starting the measurement.

In the automatic measurement, helium gas adjusted to a pressure of 20.000 psig ($2.392\times10^2$ kPa) is used. The sample chamber is purged 10 times with the helium gas; subsequently, assuming that an equilibrium state is a state in which a change in the internal pressure of the sample chamber is 0.005 (psig/min) ($3.447\times10^{-2}$ kPa/min), the purge with the helium gas is repeated until the equilibrium state is reached.

Then, the pressure of the sample chamber in the equilibrium state is measured. The volume of the sample can be calculated on the basis of the change in the pressure at the time of reaching the equilibrium state (Boyle's law).

Since the volume of the sample can be calculated, the true density of the sample can be determined from the following equation.

$$\text{True Density of Sample}(g/cm^3)=\text{Mass of Sample}(g)/\text{Volume of Sample}(cm^3)$$

Measurement of Weight Average Particle Size (D4) and Number Average Particle Size (D1)

The weight average particle size (D4) and number average particle size (D1) of toner are measured with an accurate particle size distribution analyzer "COULTER COUNTER Multisizer 3" (registered trademark, manufactured by Beckman Coulter, Inc.) equipped with a 100-μm aperture tube and based on an aperture impedance method and software "Beckman Coulter Multisizer 3 Version 3.51" (manufactured by Beckman Coulter, Inc.) dedicated to the analyzer for determining measurement conditions and analyzing measured data. The measurement is carried out at effective measurement channels of 25,000 in number, and obtained data is analyzed to calculate the D4 and D1.

The aqueous electrolyte solution to be used in the measurement can be a solution in which a special-grade sodium chloride has been dissolved in ion exchanged water to a concentration of approximately 1 mass %, such as "ISOTON II" (manufactured by Beckman Coulter, Inc.).

Before the measurement and the analysis, the dedicated software is configured as follows.

The dedicated software is run; on the "Changing Standard of Measurement (SOM)" screen, the total number of particles to be counted in the control mode is set to 50000, the number of times of measurement is set to 1, and a Kd value obtained by use of "standard particle 10.0 μm" (manufactured by Beckman Coulter, Inc.) is input. The "Threshold/Noise Level Measurement" button is selected to automatically set the threshold and noise level.

Furthermore, the current is set to 1600 μA, gain is set to 2, the electrolyte solution is set to ISOTON II, and "Flush Aperture Tube after Measurement" is selected.

On the "Setting Change from Pulse to Particle Size" screen shown by the dedicated software, the bin interval is set to a logarithmic particle size, the particle size bin is set to 256 particle size bins, and the particle size range is set to from 2 μm to 60 μm.

The measurement is specifically performed as described below.

(1) Approximately 200 ml of the above-mentioned aqueous electrolytic solution is put into a 250-ml round-bottom glass beaker which is designed for the Multisizer 3. The beaker is fixed to a sample stand, and the content in the beaker is stirred 24 times per second with a stirrer rod in a counterclockwise direction. Then, dirt and bubbles in the aperture tube are removed by the "Flushing Aperture" function of the analysis software.

(2) About 30 ml of the aqueous electrolytic solution is put into a 100-ml flat-bottom glass beaker. Then, about 0.3 mL of a solution prepared by diluting "Contaminon N" (10 mass % aqueous solution of a neutral detergent for washing precision measuring instruments, which has a pH of 7, contains a nonionic surfactant, an anionic surfactant, and an organic builder, and is manufactured by Wako Pure Chemical Industries, Ltd.) up to three times its mass with ion exchanged water is added as a dispersant to the beaker.

(3) A predetermined amount of ion exchanged water is put into the water tank of an ultrasonic dispersing machine "Ultrasonic Dispension System Tetora 150" (manufactured by Nikkaki Bios Co., Ltd.) having an electrical output of 120 W and including two oscillators with an oscillation frequency of 50 kHz, the oscillators being placed so as to be out of phase by 180° with respect to each other. Then, approximately 2 mL of the Contaminon N is put into the water tank.

(4) The beaker in the procedure (2) is inserted into the beaker-fixing hole of the ultrasonic dispersing machine, and the ultrasonic dispersing machine is operated. Then, the position of the beaker in the height direction is adjusted so that the resonance state of the liquid level of the aqueous electrolytic solution in the beaker is at a maximum.

(5) In a state in which the aqueous electrolytic solution in the beaker in the procedure (4) is exposed to ultrasonic waves, approximately 10 mg of toner is added to the aqueous electrolytic solution little by little and dispersed. The dispersion treatment under the exposure to ultrasonic waves is further continued for 60 seconds. The temperature of water in the water tank is appropriately adjusted to be from 10° C. to 40° C. for the ultrasonic dispersion.

(6) Into the round-bottom beaker used in the procedure (1) and placed in the sample stand, the aqueous electrolytic solution in which the toner has been dispersed in the procedure (5) is added dropwise with a pipette to adjust the concentration for measurement to be approximately 5%. The measurement is performed until 50000 particles are subjected to the measurement.

(7) The obtained data is analyzed with the dedicated software included in the analyzer to calculate the weight average particle size (D4) and the number average particle size (D1). The weight average particle size (D4) is the "Average Size" on the analysis/volume statistics (arithmetic mean) screen when the dedicated software is configured to show graph/vol %, and the number average particle size (D1) is the "Average Size" on the analysis/number statistics (arithmetic mean) screen when the dedicated software is configured to show graph/number %.

Calculation of Amount of Fine Powder

The amount of fine powder in toner on a number basis (number %) is determined as follows.

The number % of particles having, for example, a size of 4.0 μm or less in toner can be determined as follows. The above-mentioned analysis with Multisizer 3 is carried out, and (1) then in the above-described dedicated software, graph/number % is set so that results of the measurement are shown in a chart on a number % basis. Then, (2) the "<" of the particle-size-setting portion on the "Format/Particle Size/Statistics on Particle Size" screen is selected, and "4" is entered in the particle-size-inputting portion thereunder. (3) When the "Analysis/Statistic by Number (Arithmetic Mean)" screen is displayed, the value shown in the "<4 μm" portion is the number % of particles having a size of 4.0 μm or less in the toner.

Calculation of Amount of Coarse Powder

The amount of coarse powder in toner on a volume basis (vol %) is determined as described below.

The volume % of particles having, for example, a size of 10.0 μm or more in toner is determined as follows. The above-mentioned analysis with Multisizer 3 is carried out, and then (1) in the above-described dedicated software, graph/volume % is set so that results of the measurement are shown in a chart on a volume % basis. Then, (2) the ">" of the particle-size-setting portion on the "Format/Particle Size/Statistics on Particle Size" screen is selected, and "10" is entered in the particle-size-inputting portion thereunder. (3) When the "Analysis/Statistic by Volume (Arithmetic Mean)" screen is displayed, the value shown in the ">10 μm" portion is the volume % of particles having a size of 10.0 μm or more in the toner.

EXAMPLES

The present invention will now be further specifically describe with reference to Examples; however, the present invention is not limited thereto.

Example of Production of Porous Magnetic Particles 1

First Process Weighing and Mixing Process

The following raw materials of ferrite were prepared, 20 parts by mass of water was added to 80 parts by mass of the raw materials of ferrite, and then the product was subjected to wet mixing for 3 hours in a ball mill using zirconia having a diameter (ϕ) of 10 mm to prepare slurry. The slurry had a solid concentration of 80 mass %.

| | |
|---|---|
| $Fe_2O_3$ | 68.3 mass % |
| $MnCO_3$ | 28.5 mass % |
| $Mg(OH)_2$ | 2.0 mass % |
| $SrCO_3$ | 1.2 mass % |

Second Process: Pre-Calcination Process

The prepared slurry was dried with a spray dryer (manufactured by OHKAWARA KAKOHKI CO., LTD.), and then the product was calcined in a batch-type electric furnace under a nitrogen atmosphere (oxygen concentration: 1.0 volume %) at 1050° C. for 3.0 hours to produce pre-calcined ferrite.

Third Process: Pulverizing Process

The pre-calcined ferrite was pulverized with a crusher into a size of approximately 0.5 mm, and then the water was added thereto to prepare slurry. The slurry was prepared so as to have a solid concentration of 70 mass %. In order to prepare the slurry, pulverization was carried out for three hours with a wet-type ball mill using ⅛-inch stainless beads. The slurry was further subjected to pulverization for 4 hours in a wet-type beads mill using zirconia having a diameter of 1 mm to produce slurry of pre-calcined ferrite in which the 50% particle size (D50) on a volume basis was 1.3 μm.

Fourth Process: Granulating Process

To 100 parts by mass of the slurry of pre-calcined ferrite, 1.0 part by mass of ammonium polycarboxylate that was a dispersant and 1.5 parts by mass of polyvinyl alcohol that was a binder were added, and the product was granulated with a spray dryer (manufactured by OHKAWARA KAKOHKI CO., LTD.) into spherical particles and then dried. The granulated product was subjected to particle size control, and the resulting product was heated in a rotary electric furnace at 700° C. for 2 hours to remove organic substances such as the dispersant and binder.

Fifth Process: Calcination Process

Under a nitrogen atmosphere (oxygen concentration: 1.0 volume %), temperature was increased from room temperature to calcination temperature (1100° C.) over 2 hours, and the temperature of 1100° C. was maintained for 4 hours to calcine the product. Then, the temperature was decreased to 60° C. over 8 hours, the nitrogen atmosphere was changed to air atmosphere, and the calcined product was withdrawn at not more than 40° C.

Sixth Process: Separation Process

The agglomerated particles were crushed and then filtered through a sieve having an aperture size of 150 μm to remove coarse particles. Then, air classification was carried out to remove fine powder, and magnetic classification was performed to remove the low-magnetic content, thereby producing porous magnetic particles 1. The porous magnetic particles 1 had pores. Table 1 shows the conditions in the processes for producing the porous magnetic particles 1, and Table 2 shows the physical properties thereof.

Examples of Production of Porous Magnetic Particles 2 to 18

Except that the conditions in the processes for producing the porous magnetic particles 1 were changed as shown in Table 1, porous magnetic particles 2 to 18 were produced as in the production of the porous magnetic particles 1. Table 1 shows the conditions in the processes for producing the porous magnetic particles 2 to 18, and Table 2 shows the physical properties thereof.

TABLE 1

| Porous | Second Process Pre-Calcination Process | | Third Process Pulverization Process | | | Fourth Process Granulation Process Temperature in | Fifth Process Calcination Process | | | | | Sixth Process Separation |
|---|---|---|---|---|---|---|---|---|---|---|---|---|
| Magnetic Particle No. | Temperature (° C.) | Time (h) | Time of Pulverization in Wet-Type Ball Mill (h) | Time of Pulverization in Wet-Type Beads Mill (h) | D50 (μm) | Removal of Organic Substances (° C.) | Calcination Furnace [Electric Furnace] | Oxygen Concentration (Volume %) | Calcination Temperature (° C.) | Heat-up Time (h) | Holding Time (h) | Process Sieve Aperture (μm) |
| 1 | 1050 | 3.0 | 3.0 | 4.0 | 1.3 | 700 | Tunnel Type | 1.0 | 1100 | 2.0 | 4.0 | 150 |
| 2 | 1000 | 3.0 | 3.0 | 2.0 | 2.0 | 700 | Tunnel Type | 0.8 | 1100 | 2.7 | 4.0 | 150 |
| 3 | 1050 | 3.0 | 3.0 | 5.0 | 1.3 | 700 | Tunnel Type | 1.4 | 1100 | 2.0 | 4.0 | 150 |
| 4 | 1000 | 3.0 | 3.0 | 5.0 | 2.1 | 700 | Tunnel Type | 0.7 | 1080 | 2.7 | 4.0 | 250 |
| 5 | 1050 | 2.0 | 3.0 | 3.0 | 1.5 | 700 | Tunnel Type | 1.4 | 1100 | 2.3 | 3.9 | 150 |
| 6 | 1050 | 3.0 | 3.0 | 2.0 | 2.0 | 700 | Tunnel Type | 0.8 | 1080 | 2.7 | 4.5 | 250 |
| 7 | 1050 | 2.0 | 2.0 | 3.0 | 1.2 | 700 | Tunnel Type | 1.1 | 1050 | 2.4 | 3.8 | 150 |
| 8 | 1000 | 3.0 | 4.0 | 5.0 | 1.5 | 700 | Tunnel Type | 0.8 | 1080 | 2.6 | 4.6 | 150 |
| 9 | 1050 | 2.0 | 2.0 | 3.0 | 1.0 | 650 | Tunnel Type | 1.3 | 1050 | 2.5 | 4.0 | 150 |
| 10 | 1050 | 3.0 | 4.0 | 4.0 | 1.2 | 700 | Tunnel Type | 0.5 | 1080 | 2.2 | 4.7 | 150 |
| 11 | 1050 | 2.0 | 2.0 | 2.0 | 1.3 | 650 | Tunnel Type | 1.5 | 1050 | 2.6 | 4.0 | 150 |
| 12 | 1000 | 3.0 | 4.0 | 2.0 | 2.1 | 700 | Tunnel Type | 0.8 | 1080 | 2.5 | 4.8 | 150 |
| 13 | 1000 | 2.0 | 2.0 | 5.0 | 1.3 | 650 | Tunnel Type | 1.2 | 1050 | 1.5 | 4.0 | 150 |
| 14 | 1050 | 2.0 | 2.0 | 3.0 | 1.2 | 700 | Tunnel Type | 0.9 | 1050 | 1.0 | 2.0 | 150 |
| 15 | 1050 | 2.0 | 2.0 | 2.0 | 2.3 | 650 | Tunnel Type | 1.1 | 1100 | 2.7 | 3.3 | 150 |
| 16 | 1000 | 2.0 | 2.0 | 2.0 | 2.5 | 650 | Tunnel Type | 0.9 | 1020 | 2.7 | 3.3 | 150 |

TABLE 1-continued

| Porous | Second Process Pre-Calcination Process | | Third Process Pulverization Process | | | Fourth Process Granulation Process Temperature in | Fifth Process Calcination Process | | | | | Sixth Process Separation |
|---|---|---|---|---|---|---|---|---|---|---|---|---|
| Magnetic Particle No. | Temperature (° C.) | Time (h) | Time of Pulverization in Wet-Type Ball Mill (h) | Time of Pulverization in Wet-Type Beads Mill (h) | D50 (μm) | Removal of Organic Substances (° C.) | Calcination Furnace [Electric Furnace] | Oxygen Concentration (Volume %) | Calcination Temperature (° C.) | Heat-up Time (h) | Holding Time (h) | Process Sieve Aperture (μm) |
| 17 | 950 | 2.0 | 2.0 | 3.0 | 1.4 | 650 | Rotary Type | 1.0 | 900 | 1.3 | 3.3 | 150 |
| 18 | 950 | 2.0 | 4.0 | 5.0 | 1.5 | 700 | Rotary Type | 1.0 | 900 | 1.2 | 4.9 | 150 |

TABLE 2

| Porous Magnetic Particle No. | D50 (μm) | Surface Roughness Ra (μm) | Specific Resistance at 300 V/cm (Ω · cm) | Mercury Press-in Technique Peak Pore Size (μm) | Mercury Press-in Technique Pore Volume ($mm^3/g$) |
|---|---|---|---|---|---|
| 1 | 37.7 | 0.215 | $2.0 \times 10^8$ | 0.61 | 65 |
| 2 | 40.1 | 0.210 | $1.7 \times 10^7$ | 0.83 | 100 |
| 3 | 34.2 | 0.204 | $3.3 \times 10^9$ | 0.71 | 20 |
| 4 | 75.2 | 0.241 | $1.9 \times 10^7$ | 0.90 | 101 |
| 5 | 35.4 | 0.198 | $5.9 \times 10^9$ | 0.51 | 19 |
| 6 | 60.5 | 0.249 | $3.6 \times 10^7$ | 0.94 | 81 |
| 7 | 36.7 | 0.182 | $6.8 \times 10^8$ | 0.49 | 45 |
| 8 | 46.0 | 0.231 | $2.3 \times 10^7$ | 1.00 | 86 |
| 9 | 34.9 | 0.190 | $2.6 \times 10^9$ | 0.40 | 41 |
| 10 | 40.2 | 0.223 | $5.3 \times 10^6$ | 0.55 | 78 |
| 11 | 36.0 | 0.199 | $2.2 \times 10^9$ | 0.83 | 39 |
| 12 | 50.2 | 0.238 | $4.1 \times 10^7$ | 1.10 | 88 |
| 13 | 33.8 | 0.191 | $9.6 \times 10^8$ | 0.34 | 29 |
| 14 | 38.2 | 0.175 | $6.0 \times 10^7$ | 0.63 | 54 |
| 15 | 42.9 | 0.252 | $8.6 \times 10^8$ | 0.99 | 99 |
| 16 | 53.2 | 0.296 | $8.8 \times 10^7$ | 1.40 | 74 |
| 17 | 41.1 | 0.197 | $4.4 \times 10^8$ | 0.58 | 45 |
| 18 | 40.7 | 0.193 | $2.8 \times 10^8$ | 0.44 | 62 |

Examples of Production of Magnetic Carriers 1 to 22

First Process Resin Introduction Process

Into the stirring container of a mixing stirrer (versatile mixer NDMV manufactured by DALTON CORPORATION), 100 parts by mass of the porous magnetic particles 1 were put, the temperature was maintained at 60° C., nitrogen was introduced thereinto while the pressure was reduced to 2.3 kPa, and a resin solution 1 shown in Table 3 was dropped to the porous magnetic particles 1. The amount of the dropped resin solution 1 was adjusted to be 5.0 parts by mass relative to 100 parts by mass of the porous magnetic particles 1 on the basis of the solid resin content in the resin solution 1.

After the dropping of the resin solution 1, stirring was carried out for two hours, and then the temperature was increased to 70° C., the solvent was removed under reduced pressure to introduce the resin composition derived from the resin solution 1 into the porous magnetic particles 1.

The temperature was subsequently decreased to room temperature, the ferrite particles holding the resin which had been cured were retrieved, and nonmagnetic substances were removed by use of a magnetic separation apparatus. Then, coarse particles were removed with a vibrating sieve to produce resin-filled magnetic core particles into which the resin had been introduced.

Second Process: Resin Coting Process

Then, under reduced pressure (1.5 kPa), a resin solution 2 shown in Table 3 was put into a planetary-screw mixer (Nauta Mixer VN manufactured by Hosokawa Micron Corporation) maintained at 60° C.; the amount of the resin solution 2 was 2.0 parts by mass relative to 100 parts by mass of the porous magnetic particles on the basis of the solid resin content in the resin solution 2. In particular, one third of the total amount of the resin solution 2 was put, and removal of the solvent and a coating procedure were carried out for 20 minutes; then, another one third of the initial amount of the resin solution was put, and removal of the solvent and the coating procedure were carried out for 20 minutes; and the remaining one third of the initial amount of the resin solution was put, and removal of the solvent and the coating procedure were carried out for 20 minutes.

The magnetic carrier after the coating with the coating resin composition was transferred into a mixer having a rotatable mixing container equipped with spiral blades thereinside (drum mixer UD-AT manufactured by Sugiyama heavy industrial). The magnetic carrier was heated under a nitrogen atmosphere at 120° C. for 2 hours under agitation by rotating the mixing container 10 times per minute. The low-magnetic content was removed from the resulting magnetic carrier by magnetic separation, and the magnetic carrier was filtered through a sieve having an aperture size of 150 μm and then subjected to classification with an air classifier. In this manner, a magnetic carrier 1 having a 50% particle size (D50) of 39.5 μm on a volume distribution basis was produced.

Tables 4 and 5 show the conditions in the processes for producing the magnetic carrier 1, and Table 6 shows the physical properties thereof.

Magnetic carriers 2 to 22 were produced under conditions shown in Tables 4 and 5, and Table 6 shows the physical properties thereof. The coating process in the production of the magnetic carrier 22 was carried out as follows.

Dry Coting Process in Production of Magnetic Carrier 22

The solvent of the resin solution 2 was removed to obtain only the resin solid content, and then the resin solid content was pulverized into a weight average particle size of 50 μm; 100 parts by mass of the porous magnetic core 18 and 5.0 parts by mass of the resin solid content were put into Nobilta (manufactured by Hosokawa Micron Corporation) that was a stirrer. The content was stirred for two minutes for pre-mixing at a rate in which the outermost periphery of the stirring member was rotated 1 m per second. Then, the rate was changed to 10 m/s, and the coating process was carried out for 15 minutes at this rate to produce of the magnetic carrier particles. The low-magnetic content was removed from the magnetic carrier particles by magnetic separation, and the resulting magnetic carrier particles were filtered through a sieve having an aperture size of 150 μm and then subjected to classification with an air classifier. In this manner, the magnetic carrier 22 having a 50% particle size (D50) of 43.0 μm on a volume distribution basis was produced. Tables 4 and 5 show the conditions in the processes for producing the magnetic carrier 22, and Table 6 shows the physical properties thereof.

TABLE 3

| Resin | Resin Component | | Solvent Component | | Additive | |
|---|---|---|---|---|---|---|
| Solution No. | Type | Amount (mass %) | Type | Amount (mass %) | Type | Amount (mass %) |
| Solution 1 | SR2410 (solid concentration: 20%) manufactured by Dow Corning Toray Co., Ltd. | 50.0 | Toluene | 49.5 | γ-aminopropyltriethoxysilane | 0.5 |
| Solution 2 | Copolymer of Cyclohexyl Methacrylate/ Macromonomer of Methyl Methacrylate with Mw of 5000/ Methyl Methacrylate (solid concentration: 40%) | 50.0 | Toluene | 46.0 | Melamine/ Formaldehyde Condensate (EPOSTAR S6 manufactured by NIPPON SHOKUBAI CO., LTD.) | 3.0 |
| | | | | | Carbon Black (#25 manufactured by Mitsubishi Chemical Corporation) | 1.0 |

TABLE 4

| | | Resin Introduction Process | | | | | | |
|---|---|---|---|---|---|---|---|---|
| Carrier No. | Porous Magnetic Particle No. | Resin Solution | Solid Content Relative to 100 Parts by Mass of Porous Magnetic Particle (Parts by Mass) | Stirring Time after Dropping (h) | Temperature of Stirrer (° C.) | Stirring Time (h) | Holding Temperature (° C.) | Holding time (h) |
| 1 | 1 | 1 | 5.0 | 2.0 | 220 | 1.0 | 200 | 1.0 |
| 2 | 2 | 1 | 4.5 | 2.0 | 220 | 1.0 | 200 | 1.0 |
| 3 | 3 | 1 | 5.0 | 2.0 | 220 | 1.0 | 200 | 1.0 |
| 4 | 1 | 2 | 4.5 | 2.0 | 120 | 1.0 | 120 | 1.0 |
| 5 | 1 | 1 | 3.5 | 1.5 | 220 | 1.0 | 200 | 1.0 |
| 6 | 4 | 1 | 5.0 | 2.0 | 220 | 1.0 | 200 | 1.0 |
| 7 | 5 | 1 | 5.0 | 1.0 | 220 | 1.0 | 100 | 1.0 |
| 8 | 6 | 1 | 3.5 | 1.5 | 220 | 1.0 | 200 | 1.0 |
| 9 | 7 | 1 | 4.0 | 2.0 | 220 | 1.0 | 200 | 1.0 |
| 10 | 8 | 1 | 5.0 | 2.0 | 220 | 1.0 | 200 | 1.0 |
| 11 | 9 | 1 | 5.0 | 2.0 | 220 | 1.0 | 100 | 1.0 |
| 12 | 10 | 1 | 3.0 | 2.0 | 220 | 1.0 | 200 | 1.0 |
| 13 | 11 | 1 | 5.5 | 2.2 | 220 | 1.0 | 200 | 1.0 |
| 14 | 12 | 1 | 4.5 | 2.0 | 220 | 1.0 | 200 | 1.0 |
| 15 | 13 | 1 | 4.0 | 2.0 | 220 | 1.0 | 200 | 1.0 |
| 16 | 1 | 1 | 2.9 | 1.5 | 220 | 1.0 | 200 | 1.0 |
| 17 | 1 | 1 | 5.6 | 2.2 | 220 | 1.0 | 200 | 1.0 |
| 18 | 14 | 1 | 3.2 | 1.5 | 220 | 1.0 | 200 | 1.0 |
| 19 | 15 | 1 | 5.3 | 2.2 | 220 | 1.0 | 200 | 1.0 |
| 20 | 16 | 1 | 7.0 | 3.0 | 220 | 1.0 | 200 | 1.0 |
| 21 | 17 | 1 | 6.0 | 2.5 | 220 | 1.0 | 200 | 1.0 |
| 22 | 18 | 1 | 0.0 | — | 220 | — | — | — |

TABLE 5

| | | Coating Process | | | | | |
|---|---|---|---|---|---|---|---|
| Carrier No. | Porous Magnetic Particle No. | Resin Solution | Solid Content Relative to 100 Parts by Mass of Porous Magnetic Particle (Parts by Mass) | Coating Type | Temperature of Coating Apparatus (° C.) | Processing time (h) | Sieve Aperture (μm) |
| 1 | 1 | 2 | 2.0 | Wet | 120 | 2.0 | 150 |
| 2 | 2 | 2 | 2.0 | Wet | 120 | 2.0 | 150 |
| 3 | 3 | 2 | 2.5 | Wet | 120 | 2.0 | 150 |
| 4 | 1 | 2 | 2.5 | Wet | 120 | 2.0 | 150 |
| 5 | 1 | 1 | 2.5 | Wet | 120 | 2.0 | 150 |
| 6 | 4 | 2 | 2.0 | Wet | 120 | 2.0 | 250 |

TABLE 5-continued

| Carrier No. | Porous Magnetic Particle No. | Coating Process: Resin Solution | Solid Content Relative to 100 Parts by Mass of Porous Magnetic Particle (Parts by Mass) | Coating Type | Temperature of Coating Apparatus (° C.) | Processing time (h) | Sieve Aperture (μm) |
|---|---|---|---|---|---|---|---|
| 7 | 5 | 2 | 2.0 | Wet | 120 | 2.0 | 150 |
| 8 | 6 | 2 | 2.5 | Wet | 120 | 2.0 | 250 |
| 9 | 7 | 2 | 1.5 | Wet | 120 | 2.0 | 150 |
| 10 | 8 | 2 | 2.0 | Wet | 120 | 2.0 | 150 |
| 11 | 9 | 2 | 2.0 | Wet | 120 | 2.0 | 150 |
| 12 | 10 | 2 | 1.0 | Wet | 120 | 2.0 | 150 |
| 13 | 11 | 2 | 3.0 | Wet | 120 | 2.0 | 150 |
| 14 | 12 | 2 | 2.0 | Wet | 120 | 2.0 | 250 |
| 15 | 13 | 2 | 2.0 | Wet | 120 | 2.0 | 150 |
| 16 | 1 | 2 | 0.9 | Wet | 120 | 2.0 | 250 |
| 17 | 1 | 2 | 3.1 | Wet | 120 | 2.0 | 150 |
| 18 | 14 | 2 | 1.2 | Wet | 120 | 2.0 | 250 |
| 19 | 15 | 2 | 2.9 | Wet | 120 | 2.0 | 150 |
| 20 | 16 | 2 | 2.0 | Wet | 120 | 2.0 | 150 |
| 21 | 17 | 2 | 0.0 | — | — | — | — |
| 22 | 18 | 2 | 5.0 | Dry | — | — | — |

TABLE 6

| Magnetic Carrier No. | Porous Magnetic Particle No. | D50 (μm) | Surface Roughness Ra (μm) | Specific Resistance at 300 V/cm (Ω · cm) | True Density (g/cm$^3$) | Apparent Density (g/cm$^3$) |
|---|---|---|---|---|---|---|
| 1 | 1 | 39.5 | 0.190 | $2.5 \times 10^8$ | 3.95 | 1.88 |
| 2 | 2 | 41.2 | 0.199 | $3.3 \times 10^7$ | 3.88 | 1.92 |
| 3 | 3 | 35.0 | 0.180 | $8.0 \times 10^9$ | 4.17 | 1.85 |
| 4 | 1 | 39.5 | 0.188 | $4.8 \times 10^8$ | 4.00 | 1.95 |
| 5 | 1 | 39.4 | 0.199 | $4.5 \times 10^8$ | 4.10 | 1.90 |
| 6 | 4 | 77.0 | 0.227 | $2.3 \times 10^7$ | 3.66 | 2.04 |
| 7 | 5 | 36.6 | 0.174 | $8.6 \times 10^9$ | 4.21 | 1.93 |
| 8 | 6 | 61.9 | 0.210 | $4.6 \times 10^7$ | 4.34 | 2.00 |
| 9 | 7 | 38.5 | 0.162 | $9.5 \times 10^8$ | 4.11 | 1.86 |
| 10 | 8 | 47.0 | 0.218 | $5.7 \times 10^7$ | 4.06 | 1.94 |
| 11 | 9 | 35.9 | 0.177 | $3.5 \times 10^9$ | 4.04 | 1.99 |
| 12 | 10 | 41.6 | 0.219 | $7.5 \times 10^6$ | 3.95 | 1.84 |
| 13 | 11 | 37.8 | 0.161 | $4.3 \times 10^{10}$ | 4.03 | 1.73 |
| 14 | 12 | 51.6 | 0.214 | $9.7 \times 10^7$ | 4.16 | 1.97 |
| 15 | 13 | 35.3 | 0.164 | $2.8 \times 10^9$ | 4.18 | 2.25 |
| 16 | 1 | 38.5 | 0.207 | $2.3 \times 10^8$ | 3.99 | 1.90 |
| 17 | 1 | 39.8 | 0.171 | $3.7 \times 10^9$ | 3.89 | 1.85 |
| 18 | 14 | 40.0 | 0.166 | $8.6 \times 10^7$ | 4.04 | 1.93 |
| 19 | 15 | 44.1 | 0.216 | $4.5 \times 10^9$ | 3.96 | 1.97 |
| 20 | 16 | 54.9 | 0.224 | $1.3 \times 10^8$ | 3.83 | 1.65 |
| 21 | 17 | 42.7 | 0.150 | $6.0 \times 10^8$ | 3.90 | 1.79 |
| 22 | 18 | 43.0 | 0.147 | $5.3 \times 10^{10}$ | 3.79 | 1.80 |

Example of Production of Toner 1

The following materials were thoroughly mixed with each other in a Henschel mixer (FM-75J manufactured by Mitsui Mining Co., Ltd.,).

| | |
|---|---|
| Binder resin (polyester resin, Tg: 58° C., acid value: 15 mgKOH/g, hydroxyl value: 15 mgKOH/g, peak molecular weight: 5800, number average molecular weight: 3500, weight average molecular weight: 95000) | 100 parts by mass |
| C.I. Pigment Blue 15:3 | 4.5 parts by mass |
| Aluminum compound of 1,4-di-t-butylsalicylate | 0.5 parts by mass |
| Normal paraffin wax (melting point: 78° C.) | 6.0 parts by mass |

Then, the mixed product was kneaded in a twin-screw kneader (PCM-30 manufactured by Ikegai Ironworks Corp) at 130° C. at a feeding rate of 10 kg/h (temperature of the product ejected after the kneading was approximately 150° C.). The kneaded product was cooled, roughly crushed with a hammer mill, and then finely pulverized with a mechanical pulverizer (T-250 manufactured by Turbo Kogyo Co., Ltd.) at a feeding rate of 15 kg/hr. Through this process, particles having the following characteristics were produced: weight average particle size: 5.5 μm, proportion of particles having a particle size of not more than 4.0 μm: 55.6 number %, and proportion of particles having a particle size of not less than 10.0 μm: 0.8 volume %.

The produced particles were subjected to classification with a rotary classifier (TTSP100 manufactured by Hosokawa Micron Corporation) to remove fine powder and coarse powder. In this manner, cyan toner particles 1 having the following characteristics were produced: weight average particle size: 6.4 μm, proportion of particles having particles size of not more than 4.0 μm: 25.8 number %, and proportion of particles having particle size of not less than 10.0 μm: 2.5 volume %.

The following materials were put into a Henschel mixer (FM-75 manufactured by NIPPON COKE & ENGINEERING COMPANY, LIMITED) and mixed with each other at a peripheral speed of rotational blades of 35.0 (m/s) for 3 minutes to produce a cyan toner 1 in which silica and titanium oxide were adhering onto the surfaces of the cyan toner particles 1.

| | |
|---|---|
| Cyan toner particles 1 | 100 parts by mass |
| Silica (fine silica particles prepared by a sol-gel method were surface-treated with 1.5 mass % of hexamethyldisilazane and then subjected to classification into predetermined particle size distribution) | 3.5 parts by mass |
| Titanium oxide (metatitanic acid having an anatase crystalline form was surface-treated with an octylsilane compound) | 0.5 parts by mass |

The produced toner had the following characteristics: weight average particle size: 6.4 μm, proportion of particles having a particles size of not more than 4.0 μm: 25.8 number %, and proportion of particles having a particle size of not less than 10.0 μm: 2.5 volume %.

Example 1

To 91 parts by mass of the magnetic carrier 1, 9 parts by mass of the toner 1 was added, and these materials were shaken with a shaker (YS-8D manufactured by YAYOI CO., LTD.) to prepare a two-component developer. The shaker was oscillated at 200 rpm for 2 minutes.

In addition, 90 parts by mass of the toner 1 was added to 10 parts by mass of the magnetic carrier 1, and these materials were mixed with each other with a V-shaped mixer at normal temperature and humidity of 23° C./50% RH for 5 minutes to produce a developer for replenishment.

The two-component developer and the developer for replenishment were subjected to the following evaluations.

A color copier imageRUNNER ADVANCE C9075 PRO manufactured by CANON KABUSHIKI KAISHA was modified and used as an image forming apparatus.

The two-component developer was put into a developing device, and a container into which the developer for replenishment had been put was attached. Images were formed for evaluations before or after an endurance test.

In the endurance test, the developing device was run idle for 10 hours under a printing environment of temperature: 23° C./humidity: 5% RH (hereinafter referred to as "N/L"). Under a printing environment of temperature: 30° C./humidity: 80% RH (hereinafter referred to as "H/H"), hundred thousand sheets on which a chart had been formed at a color output of FFH and an image rate of 40% were output. The term "FFH" refers to 256 tones in hexadecimal; 00h indicates the first tone of the 256 tones (white part), and FFH indicates the 256th tone of the 256 tones (solid part).

The number of image-formed sheets to be output for the endurance test was hundred thousand.

The conditions were as follows.

Sheet: sheet for laser beam printer CS-814 (81.4 g/m$^2$) (manufactured by Canon Marketing Japan Inc.)

Image forming speed: the printer was modified so that the printer was able to output 80 A4-size sheets per minute.

Development: the printer was modified so that development contrast was able to be changed as needed and so that the printer did not perform automatic compensation.

Output: the printer was modified so that the printer was able to output unicolor images.

Idle running of developing device: the printer was modified so that the peripheral speed of the sleeve of the developing device of the printer was freely changed to run idle the developing device.

The following evaluations were performed.

(1) Leakage (White Spot)

An initial image was evaluated under an N/L environment (23° C. and 5% RH). Then, the developing device was run idled for 10 hours, and leakage was subsequently evaluated. In particular, five pieces of A-4 size plain paper on which a solid image (FFH) had been fully printed were serially output, the number of white spots having a diameter of 1 mm or more was counted on each image, and the total number of the white spots on the five sheets was calculated to perform the evaluation on the basis of the following criteria.

A: zero

B: one or two

C: three or four

D: five or more (2) Blank Dot

An initial image was evaluated under an N/L environment (23° C. and 5% RH). Then, the developing device was run idled for 10 hours, and then a striped chart including halftone portions (30H, width: 10 mm) and solid black portions (FFH, width: 10 mm) alternately formed in a direction intersecting a direction in which transfer paper was conveyed was output. This chart was read with a scanner and binarized. In the binarized image, an arbitrary line in the direction in which transfer paper was conveyed was selected, and luminance distribution (256 tones) on the line was obtained. In a changing region from a solid black portion to a halftone portion, the sum of differences between an original luminance of the halftone portion and the measured luminance was considered to be the blank dot level. The original luminance of the halftone portion equals a luminance at a rear end of the halftone portion. The degree of the blank dot was evaluated on the basis of the following criteria.

A: less than 20

B: 20 or more and less than 30

C: 30 or more and less than 50

D: 50 or more (3) Evaluation of Damaged Member of Copier

In the endurance test, an A4-size sheet on which an FFH image had been fully formed was output under an H/H environment (30° C., 80% RH) after output of every 1000 sheets to evaluate whether or not a scattered carrier caused damages of the members of the copier, such as a white streak and a spot.

At the moment that at least two image defects, such as a white streak and a spot, were found on an FFH image printed fully on an A4-size sheet after output of every 1000 sheets, the number of sheets which had been spent for the endurance test was counted, and the number of the sheets was used as the evaluation criteria in this case. Only cyan developer was used for the evaluation.

A: no image defect found even after output of 100000 sheets

B: image defects observed after output of 80000 or more sheets

C: image defects observed after output of 50000 or more sheets

D: image defects observed before output of 50000 sheets (4) Carrier Adhesion

Under an H/H environment (30° C., 80% RH), printing was carried out for the endurance test, and then carrier adhesion was evaluated. In particular, in printing of a OOH image and an FFH image, the printer was turned off in the middle of the printing, and a transparent adhesive tape was attached to the electrostatic latent image-bearing member before the electrostatic latent image-bearing member was cleaned, thereby obtaining a sample. The number of the magnetic carrier particles which had remained on 3-cm square area of the electrostatic latent image-bearing member was counted, and the number of the residual carrier particles per area of 1 $cm^2$ was calculated. Obtained number was evaluated on the basis of the following criteria. Only cyan developer was used for the evaluation.

A: two or less
B: three to five
C: six to nine
D: 10 or more (5) Image Density

Under an H/H environment (30° C., 80% RH), an initial image was evaluated, printing for the endurance test was carried out, and then a solid image (FFH) was printed. The density of the image was measured with a densitometer X-Rite404A (manufactured by X-Rite Inc.), and the average of results obtained at six points on the image was calculated and defined as image density. Difference in image density between the image initially formed and the image formed after the printing for the endurance test was evaluated on the basis of the following criteria.

A: difference in density was less than 0.10
B: difference in density was 0.10 or more and less than 0.15
C: difference in density was 0.15 or more and less than 0.20
D: difference in density was 0.20 or more (6) Fogging Under an H/H environment (30° C., 80% RH), an initial image was evaluated, printing for the endurance test was carried out, and then a white solid image was printed fully on an A4-size sheet. The whiteness of the sheet before being subjected to the printing was measured with a reflectometer (manufactured by Tokyopenshoku. co., Ltd.), and the difference thereof from the whiteness of the solid image was determined to calculate fogging density (%). The fogging density was evaluated on the basis of the following criteria.

A: less than 1.0%
B: 1.0% or more and less than 1.5%
C: 1.5% or more and less than 2.0%
D: 2.0% or more (7) Resistance to Roughness of Halftone Image Under an H/H environment (30° C., 80% RH), an initial image was evaluated, printing for the endurance test was carried out (100000 sheets), and a halftone image (30H) was printed on one A4-size sheet. In the halftone image, the areas of 1000 dots were measured with a digital microscope VHX-500 (wide-range zoom lens VH-Z100 manufactured by KEYENCE CORPORATION). The number average area (S) of the dots and the standard deviation (σ) of the areas of the dots were calculated, and the index of dot reproducibility was calculated from the following equation. The roughness of the halftone image was evaluated on the basis of the index of dot reproducibility (I).

$$\text{Index of Dot Reproducibility}(I)=(\sigma/S)\times 100$$

Only cyan toner was used for the evaluation of roughness, and the following evaluation criteria were employed.

A: the index I was less than 3.0
B: the index I was 3.0 or more and less than 5.0
C: the index I was 5.0 or more and less than 8.0
D: the index I was 8.0 or more (8) Toner Scattering Under an H/H environment (30° C., 80% RH), an initial image was evaluated, printing for the endurance test was carried out (landscape printing on an A4-size sheet, image rate: 40%), and then the developing device was removed from the printer. The inside and outside of the developing device and printer were visually observed to find toner scattering, and result of the observation was evaluated on the basis of the following criteria.

A: no toner scattering observed
B: slight toner scattering observed
C: some toner scattering observed
D: significant toner scattering observed (9) Synthetic Judgment Results of the above-mentioned evaluations (1) to (9) were converted into numerical values (A=5, B=3, C=2, and D=0), and the sum of the numerical values was evaluated on the basis of the following criteria.

A: 36 or more
B: 26 to 35
C: 16 to 25
D: 15 or less

Example 1 exhibited very good results in all of the evaluations. Tables 7 and 8 show the results of the evaluations.

Examples 2 to 13 and Comparative Examples 1 to 9

Except that magnetic carriers 2 to 22 were used, two-component developers and developers for replenishment were prepared as in Example 1. Except that prepared developers were used, the evaluations were carried out as in Example 1. Tables 7 and 8 show results of the evaluations.

TABLE 7

| | | | N/L Environmental Evaluation Initial State→after Running Idle for 10 h | | | | H/H Environmental Evaluation Initial State→after Endurance Test | | | |
|---|---|---|---|---|---|---|---|---|---|---|
| | Magnetic Carrier | Porous Magnetic | Leakage [White Spot] | | Blank Dot | | Evaluation of Damage of Member of Copier (Number of Sheets before Image Defect) | | Carrier Adhesion | |
| | No. | Particles | Number | Rank | Result of Evaluation | Rank | | Rank | Number | Rank |
| Example 1 | 1 | 1 | 0 | A | 5→17 | A | — | A | 1 | A |
| Example 2 | 2 | 2 | 1 | B | 5→18 | A | — | A | 2 | A |
| Example 3 | 3 | 3 | 0 | A | 6→24 | B | — | A | 1 | A |
| Example 4 | 4 | 1 | 0 | A | 6→19 | A | — | A | 2 | A |
| Example 5 | 5 | 1 | 1 | B | 6→19 | A | — | A | 3 | B |
| Example 6 | 6 | 4 | 2 | B | 8→22 | B | 81000 | B | 2 | A |
| Example 7 | 7 | 5 | 0 | A | 8→26 | A | 89000 | B | 5 | B |

TABLE 7-continued

| | | | N/L Environmental Evaluation Initial State→after Running Idle for 10 h | | | | H/H Environmental Evaluation Initial State→after Endurance Test | | | |
|---|---|---|---|---|---|---|---|---|---|---|
| | Magnetic Carrier | Porous Magnetic | Leakage [White Spot] | | Blank Dot | | Evaluation of Damage of Member of Copier (Number of Sheets before Image Defect) | | Carrier Adhesion | |
| | No. | Particles | Number | Rank | Result of Evaluation | Rank | | Rank | Number | Rank |
| Example 8 | 8 | 6 | 2 | B | 8→23 | B | 64000 | C | 7 | C |
| Example 9 | 9 | 7 | 0 | A | 8→24 | B | 82000 | B | 4 | B |
| Example 10 | 10 | 8 | 2 | B | 8→19 | A | 52000 | C | 6 | C |
| Example 11 | 11 | 9 | 0 | A | 10→31 | C | 69000 | C | 5 | B |
| Example 12 | 12 | 10 | 3 | C | 9→28 | B | 59000 | C | 9 | C |
| Example 13 | 13 | 11 | 0 | A | 17→44 | C | — | A | 7 | C |
| Comparative Example 1 | 14 | 12 | 3 | C | 10→32 | C | 39000 | D | 11 | D |
| Comparative Example 2 | 15 | 13 | 0 | A | 20→34 | C | 45000 | D | 7 | C |
| Comparative Example 3 | 16 | 1 | 6 | D | 12→27 | B | — | A | 6 | C |
| Comparative Example 4 | 17 | 1 | 0 | A | 26→54 | D | 82000 | B | 10 | D |
| Comparative Example 5 | 18 | 14 | 3 | C | 17→34 | C | 48000 | D | 5 | B |
| Comparative Example 6 | 19 | 15 | 1 | B | 24→40 | C | 18000 | D | 11 | D |
| Comparative Example 7 | 20 | 16 | 3 | C | 14→29 | B | 10000 | D | 12 | D |
| Comparative Example 8 | 21 | 17 | 5 | D | 17→44 | C | — | A | 7 | C |
| Comparative Example 9 | 22 | 18 | 3 | C | 38→60 | D | — | A | 15 | D |

TABLE 8

| | | | H/H Environmental Evaluation Initial State→after Endurance Test | | | | | | | | |
|---|---|---|---|---|---|---|---|---|---|---|---|
| | Magnetic Carrier | Porous Magnetic | Image Density | | Evaluation of Fogging (Fogging Density) | | Halftone Reproducibility | | Toner Scattering | Synthetic Judgment | |
| | No. | Particles | | Rank | | Rank | | Rank | Rank | Evaluative Index | Rank |
| Example 1 | 1 | 1 | 1.52→1.56 | A | 0.3→0.5 | A | 1.5→2.5 | A | A | 40 | A |
| Example 2 | 2 | 2 | 1.50→1.55 | A | 0.4→0.6 | A | 1.4→2.8 | A | A | 38 | A |
| Example 3 | 3 | 3 | 1.57→1.66 | A | 0.6→0.9 | A | 1.7→3.0 | B | A | 36 | A |
| Example 4 | 4 | 1 | 1.52→1.59 | A | 0.5→1.1 | B | 1.5→2.9 | A | B | 36 | A |
| Example 5 | 5 | 1 | 1.62→1.73 | B | 0.5→1.4 | B | 2.1→4.0 | B | B | 28 | B |
| Example 6 | 6 | 4 | 1.60→1.65 | A | 0.4→1.1 | B | 2.4→5.4 | C | B | 27 | B |
| Example 7 | 7 | 5 | 1.56→1.66 | B | 0.5→1.2 | B | 3.5→5.0 | C | B | 27 | B |
| Example 8 | 8 | 6 | 1.60→1.67 | A | 1.0→1.4 | B | 2.0→4.6 | B | A | 26 | B |
| Example 9 | 9 | 7 | 1.54→1.68 | B | 0.4→1.0 | B | 2.2→3.7 | B | B | 25 | B |
| Example 10 | 10 | 8 | 1.60→1.70 | B | 0.6→1.4 | B | 2.4→5.5 | C | B | 24 | C |
| Example 11 | 11 | 9 | 1.54→1.73 | C | 0.4→1.9 | C | 1.9→3.2 | B | A | 24 | C |
| Example 12 | 12 | 10 | 1.51→1.66 | C | 0.8→1.4 | B | 2.8→5.5 | C | C | 21 | C |
| Example 13 | 13 | 11 | 1.54→1.70 | C | 0.6→1.7 | C | 3.6→5.9 | C | C | 21 | C |
| Comparative Example 1 | 14 | 12 | 1.54→1.77 | D | 0.6→1.9 | C | 3.6→7.1 | C | C | 13 | D |
| Comparative Example 2 | 15 | 13 | 1.52→1.75 | D | 0.5→1.6 | C | 1.4→8.1 | D | D | 11 | D |
| Comparative Example 3 | 16 | 1 | 1.49→1.69 | D | 0.7→2.9 | D | 3.6→8.8 | D | D | 10 | D |
| Comparative Example 4 | 17 | 1 | 1.60→1.81 | D | 0.6→2.6 | D | 3.5→9.3 | D | D | 8 | D |
| Comparative Example 5 | 18 | 14 | 1.54→1.75 | D | 0.8→2.3 | D | 3.7→8.4 | D | D | 7 | D |
| Comparative Example 6 | 19 | 15 | 1.54→1.69 | C | 1.1→2.8 | D | 3.5→8.0 | D | D | 7 | D |
| Comparative Example 7 | 20 | 16 | 1.60→1.77 | C | 0.5→2.8 | D | 1.6→3.7 | B | D | 10 | D |
| Comparative Example 8 | 21 | 17 | 1.66→1.88 | D | 0.6→2.7 | D | 3.4→8.8 | D | D | 9 | D |
| Comparative Example 9 | 22 | 18 | 1.60→1.80 | D | 0.6→3.0 | D | 1.9→9.9 | D | D | 7 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-113777 filed May 30, 2013, which is hereby incorporated by reference herein in its entirety.

What is claimed is:

1. A magnetic carrier comprising:

resin-filled magnetic core particles including porous magnetic particles and resin held in the pores of the porous magnetic particles; and a resin coating layer formed on the surface of each of the resin-filled magnetic core particles, wherein (i) the surface roughness Ra of the porous magnetic particles is in the range of 0.180 μm to 0.250 μm, (ii) within the pore size ranging from 0.1 μm to 3.0 μm in the pore size distribution of the porous magnetic particles, the peak pore size in which the differential pore volume is maximum is in the range of 0.40 μm to 1.00 μm, (iii) the amount of the resin held in the pores is in the range of 3.0 parts by mass to 5.5 parts by mass relative to 100 parts by mass of the porous magnetic particles, (iv) the amount of resin used for forming the resin coating layer is in the range of 1.0 part by mass to 3.0 parts by mass relative to 100 parts by mass of the porous magnetic particles, and (v) the surface roughness Ra of the magnetic carrier is in the range of 0.160 μm to 0.220 μm.

2. The magnetic carrier according to claim 1, wherein the pore volume of the porous magnetic particles is in the range of 20 $mm^3/g$ to 100 $mm^3/g$.

3. The magnetic carrier according to claim 1, wherein the resin coating layer of the magnetic carrier is formed of an acrylic resin, and the acrylic resin is a copolymer of an acrylic monomer having a molecular structure containing a cyclic hydrocarbon group and another monomer.

4. The magnetic carrier according to claim 1, wherein the resin held in the pores of the porous magnetic particles is a silicone resin.

5. The magnetic carrier according to claim 1, wherein the specific resistance of the magnetic carrier at a field intensity of 2000 V/cm is in the range of 1.0×107 Ω·cm to 1.0×1010 Ω·cm.

6. A two-component developer comprising:

toner containing a binder resin, a colorant, and a release agent; and a magnetic carrier, wherein the magnetic carrier is the magnetic carrier according to any one of claims 1 to 5.

7. An image forming method comprising:

a charging step for charging an electrostatic latent image-bearing member;

an electrostatic latent image-forming step for forming an electrostatic latent image on the surface of the electrostatic latent image-bearing member;

a developing step for developing the electrostatic latent image with a two-component developer held in a developing device to form a toner image;

a transferring step for transferring the toner image to a transfer medium optionally with an intermediate transfer medium; and a fixing step for fixing the transferred toner image to the transfer medium, wherein the two-component developer is the two-component developer according to claim 6.

8. A developer for replenishment which is used in an image forming method, the image forming method comprising:

a charging step for charging an electrostatic latent image-bearing member;

an electrostatic latent image-forming step for forming an electrostatic latent image on the surface of the electrostatic latent image-bearing member;

a developing step for developing the electrostatic latent image with a two-component developer held in a developing device to form a toner image;

a transferring step for transferring the toner image to a transfer medium optionally with an intermediate transfer medium; and a fixing step for fixing the transferred toner image to the transfer medium, wherein the developer for replenishment is supplied to the developing device when the toner concentration in the two-component developer held in the developing device is decreased, an excessive magnetic carrier in the developing device is optionally ejected from the developing device, wherein the developer for replenishment contains a magnetic carrier for replenishment and toner containing a binder resin, a colorant, and a release agent, the amount of the toner is in the range of 2 parts by mass to 50 parts by mass relative to 1 part by mass of the magnetic carrier for replenishment, and the magnetic carrier for replenishment is the magnetic carrier according to any one of claims 1 to 5.

9. An image forming method comprising:

a charging step for charging an electrostatic latent image-bearing member;

an electrostatic latent image-forming step for forming an electrostatic latent image on the surface of the electrostatic latent image-bearing member;

a developing step for developing the electrostatic latent image with a two-component developer held in a developing device to form a toner image;

a transferring step for transferring the toner image to a transfer medium optionally with an intermediate transfer medium; and a fixing step for fixing the transferred toner image to the transfer medium, wherein a developer for replenishment is supplied to the developing device when the toner concentration in the two-component developer held in the developing device is decreased, an excessive magnetic carrier in the developing device is optionally ejected from the developing device, wherein the developer for replenishment contains a magnetic carrier for replenishment and toner containing a binder resin, a colorant, and a release agent, the amount of the toner is in the range of 2 parts by mass to 50 parts by mass relative to 1 part by mass of the magnetic carrier for replenishment, and the magnetic carrier for replenishment is the magnetic carrier according to any one of claims 1 to 5.

* * * * *